US007026278B2

(12) United States Patent
Price et al.

(10) Patent No.: US 7,026,278 B2
(45) Date of Patent: Apr. 11, 2006

(54) RINSE-ADDED FABRIC TREATMENT COMPOSITION, KIT CONTAINING SUCH, AND METHOD OF USE THEREFOR

(75) Inventors: Kenneth Nathan Price, Wyoming, OH (US); Jean-Luc Philippe Bettiol, Brussels (BE); Nicola Kay Brown, Tyne and Wear (GB); Simon Richard Green, Tyne & Wear (GB); Li Li, Beijing (CN); Helen Frances O'Connor, Loveland, OH (US); Massimo Morini, Tervuren (BE)

(73) Assignee: The Procter & Gamble Company, Cincinnati, OH (US)

( * ) Notice: Subject to any disclaimer, the term of this patent is extended or adjusted under 35 U.S.C. 154(b) by 643 days.

(21) Appl. No.: 09/885,697

(22) Filed: Jun. 20, 2001

(65) Prior Publication Data

US 2002/0111285 A1 Aug. 15, 2002

Related U.S. Application Data

(60) Provisional application No. 60/213,328, filed on Jun. 22, 2000, provisional application No. 60/223,502, filed on Aug. 7, 2000, and provisional application No. 60/266,674, filed on Feb. 6, 2001.

(51) Int. Cl.

| | |
|---|---|
| ***C11D 3/26*** | (2006.01) |
| ***C11D 3/04*** | (2006.01) |
| ***C11D 7/32*** | (2006.01) |

(52) U.S. Cl. ..... 510/522; 510/521; 510/526; 510/466; 510/504; 510/488

(58) Field of Classification Search ..... 510/466, 510/488, 521, 522, 524, 525, 526, 504
See application file for complete search history.

(56) References Cited

U.S. PATENT DOCUMENTS

| | | | | |
|---|---|---|---|---|
| 3,637,495 | A | | 1/1972 | Eckert et al. |
| 3,644,204 | A | | 2/1972 | Heins et al. |
| 3,656,353 | A | | 4/1972 | Ciko |
| 3,904,359 | A | | 9/1975 | Ramachandran |
| 3,915,633 | A | | 10/1975 | Ramachandran |
| 3,974,076 | A | | 8/1976 | Wiersema et al. |
| 4,179,382 | A | | 12/1979 | Rudkin et al. |
| 4,438,009 | A | | 3/1984 | Benicek et al. |
| 4,595,527 | A | | 6/1986 | Gipp |
| 4,648,987 | A | | 3/1987 | Smith et al. |
| 4,738,792 | A | | 4/1988 | Ertle |
| 4,814,095 | A | | 3/1989 | Puchta et al. |
| 4,818,242 | A | | 4/1989 | Burmeister et al. |
| 4,828,750 | A | | 5/1989 | Simion et al. |
| 5,589,099 | A | * | 12/1996 | Baum ..... 510/514 |
| 5,612,410 | A | | 3/1997 | Kondo et al. |
| 5,686,376 | A | | 11/1997 | Rusche et al. |
| 6,004,922 | A | * | 12/1999 | Watson et al. ..... 510/476 |
| 6,077,317 | A | | 6/2000 | Murphy |
| 6,169,063 | B1 | * | 1/2001 | Kvietok et al. ..... 510/317 |
| 6,593,287 | B1 | * | 7/2003 | Jordan, IV et al. ..... 510/475 |

FOREIGN PATENT DOCUMENTS

| | | | |
|---|---|---|---|
| EP | 456315 B1 | | 11/1991 |
| JP | 1021297 | | 8/1998 |
| WO | WO 07/42292 | * | 11/1997 |
| WO | WO 98/13456 A1 | | 4/1998 |

* cited by examiner

*Primary Examiner*—Gregory R. Del Cotto
(74) *Attorney, Agent, or Firm*—Mark A. Charles; Brahm J. Corstanje; Kim William Zerby

(57) ABSTRACT

A rinse-added fabric treatment composition having a rinse aid increases the rinse capacity of an aqueous rinse bath solution for removing laundry residue from laundered fabrics. When properly diluted in water, the rinse-added fabric treatment composition provides a rinse bath solution having a rinsing capacity of greater than 1. In addition, a rinse-added fabric treatment composition reduces the surfactant residue on a fabric, and includes from about 0.05% to about 10% of a residue reduction agent, a suds suppresser, and the balance adjunct ingredients. The residue reduction agent is selected from a cationic residue reduction agent, a zwitterionic residue reduction agent, and a combination thereof. Moreover, methods for reducing surfactant residue on fabric and a method for reducing the amount of water used in a rinsing step of a laundry process are included. A kit for improving the rinsing capacity of water includes a rinse-added fabric treatment composition and an instruction set.

18 Claims, 1 Drawing Sheet

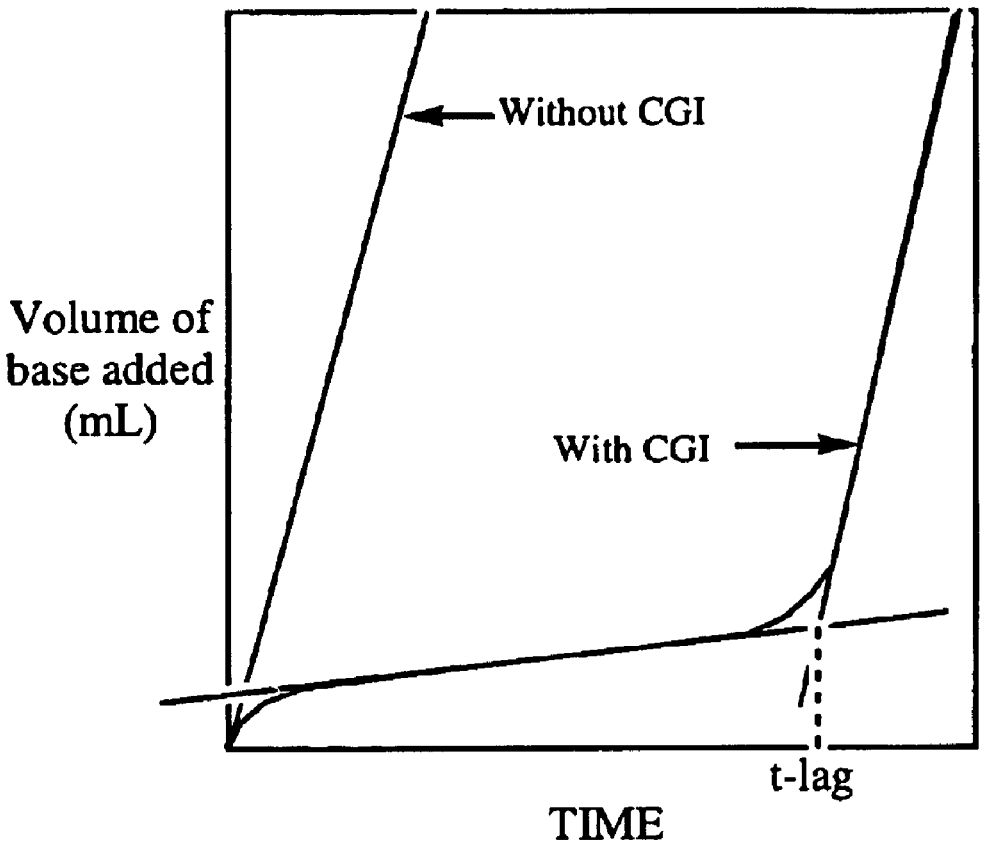
FIGURE

RINSE-ADDED FABRIC TREATMENT COMPOSITION, KIT CONTAINING SUCH, AND METHOD OF USE THEREFOR

CROSS REFERENCE TO RELATED APPLICATION

This patent application claims the benefit of U.S. Provisional Application Serial No. 60/213,328 filed Jun. 22, 2000 by Bettiol, et al.; U.S. Provisional Application Ser. No. 60/223,502 filed Aug. 7, 2000 by Bettiol, et al.; and U.S. Provisional Application Ser No. 60/266,674 filed Feb. 6, 2001 by Bettiol, et al.

BACKGROUND OF THE INVENTION

I. Field of the Invention

The present invention relates to rinse-added treatment compositions for fabrics, in particular, compositions for the hand rinsing of fabrics as well as the rinsing of fabrics in top loaded non-automated washing machines as well as automated washing machines after the fabrics have been laundered with a detergent composition. The present invention also relates to methods for increasing the rinsing capacity of aqueous rinse bath solutions as well as methods for removing greater quantities of laundry residue from laundered fabrics than is achieved in rinse baths consisting only of water. Further, the present invention relates to laundry rinse bath solutions with improved rinsing capacity.

II. Description of the Prior Art

The trend for washing is to use a washing machine wherein the laundry detergent and a fabric softening composition are dispensed from the washing machine via two separate compartments, thereby ensuring the automated release of the detergent at the beginning of the washing process and the release of the softening composition in the rinse process, usually near the end of the rinse process, or where multiple rinses are selected, during the final rinse process.

In most countries under development, the consumer's washing habit is to wash their garments with either non-automated top loaded washing machines (i.e. apparatus which comprises two separated cubicles, one for washing or rinsing, and one for spinning), or in basins or buckets. The washing in basins or buckets involves a manual operation with the multiple cumbersome steps of damping the fabrics, washing with detergent, wringing, and rinsing one or more times with water. Similarly, when washing in non-automated top loaded washing machines, the washing is operated by placing the fabric with detergent in the cubicle containing water, providing agitation, removing the fabrics from the cubicle containing the detergent liquor, placing the fabric in the spinning cubicle for spinning step, empty the detergent liquor from the other cubicle and replace it by fresh water and then put back the spinned fabrics for rinsing. The rinsing step of spinning, rinsing, and spinning being often reiterated several times to obtain acceptably rinsed fabrics. As such rinsing is usually done with clean water, this method of rinsing can be a major problem in regions experiencing water shortages.

Further, hand-washing is not limited to any particular geographical region. Although certain areas having limited access to modern appliances have a higher prevalence of hand washing, the need for hand-washing, including manual rinsing, is universal at least with respect to certain items of clothing and fabric articles. Hence, even with modern washing machines having a dedicated rinsing step, there are still many garments, especially those manufactured from "fine fabric" material (i.e. silk) or those which comprise "soft woven" material (i.e. woolen knitted sweaters) that are commonly "laundered by hand". "Delicates" and/or "personal" articles typically require hand-washing for proper care.

There are several disadvantages associated with hand washing. Foremost, hand washing typically limits the temperature at which the fabrics are washed, usually within a range tolerable to the person washing the garment. In addition, hand washing and/or washing in non-automated top loaded washing machines, typically is accompanied by high detergent to water ratio and/or high soil to water ratio (high soil loading). During such laundering the fabrics usually become saturated with residual detergent and/or dirt and particulate matter upon transfer to the rinse step.

Although this saturation problem is more acute with manual washing and/or washing in non-automated top loaded washing machines, it is also a problem for automated washing machines when the rinsing process is too short or is inefficient due to the characteristics of the particular articles being laundered. For instance, it is not uncommon in automated machines for the consumer to overload the machine or to program too little water for the amount of fabrics being laundered. In either case, the fabrics will not be thoroughly rinsed at the completion of the rinse cycle. Automated machine washing is also characterized by a high detergent to water ratio such that laundered fabrics are commonly saturated with residual detergent at the beginning of the rinse cycle.

Further, the use of conventional detergent products such as the so called "High Suds Detergents" in any washing method commonly results in suds being carried over to the rinse bath solution requiring additional time, energy and water to thoroughly rinse the laundered fabrics.

The conservation of resources such as energy and water is not to be underestimated. These types of resources are being stretched to their limits in many communities around the world. The majority of the water used in a typical laundering process is consumed during one or more rinsing cycles. As such, governments are beginning to provide incentives to washing machine manufacturers to reduce the amount of water that is consumed in each laundry process. Because of the disproportionate amount of water that is used during the rinse cycle(s), the industry is searching for ways to make the rinsing process more efficient, preferably by shortening rinse times and/or by reducing the number of rinse cycles.

Historically, rinse-added fabric treating compositions were not intended to improve the efficiency or rinsing capacity of the rinse bath solution, but rather were in the nature of laundry "sours" that contained a neutralizing agent, typically a mild acid, to neutralize the pH of the highly alkaline wash liquor. It was believed that staining of fabrics in the rinse from iron and rust could be avoided by rapidly neutralizing the pH of the rinse bath solution. U.S. Pat. No. 3,676,353 discloses such a laundry sour composition.

As the use of fabric softening compounds and compositions developed, cationic fabric softener actives were added to laundry sour compositions as disclosed in U.S. Pat. Nos. 3,637,495, 3,644,204 and 3,904,359. Similarly, U.S. Pat. No. 4,814,095 discloses an after-wash treatment composition that utilizes a layered silicate as the softening component of the composition. Again, however, none of these compositions are directed at improving the efficiency of the rinse or increasing the capacity of the rinse bath solution to remove foreign materials from the laundered fabrics.

U.S. Pat. No. 4,828,750 to Simion, et al., granted on May 9, 1989 discloses an fabric rinse composition for allegedly removing residual soap and surfactants left on clothes during washing. This composition consists essentially of low levels of nonionic surfactant and an organic acid to allegedly remove the residual soap and surfactant from fabrics (i.e., wool) which remain after it has already been rinsed with hard water (see, e.g., col. 5, lines 6–11). However, this composition is not directed to reducing water use, reducing suds, and/or improving rinse bath solution clarity.

More recently, Japanese Patent Application No. JP 10219297 discloses an after-treatment agent for commercial laundry washing that comprises a polycarboxylic acid for neutralizing the highly alkaline wash or rinse bath solutions. However, similar to the laundry sours, this composition focuses on reducing the pH of the laundry solutions to neutrality or approximately 7.

Accordingly, there is a need for methods and compositions that will relieve or ease the burden of washing by providing a more efficient rinse bath solution that will allow the consumer to thoroughly rinse their laundered fabrics in a single rinse process as well as aid in reducing the amount of water and energy that is consumed in the laundering process.

There is also a need for methods and compositions that can improve the removal of foreign materials and laundry residue from fabrics. The removal of these residues tends to restore fabrics to their natural softness and feel as well as restoring their whiteness and colors, thereby enhancing the cleaning effect of the overall laundry process.

Furthermore, the removal of laundry residues also removes allergens and skin irritants that might have been deposited on the fabrics during previous wear or during the laundering process.

Likewise, there is a need for methods and compositions that provide for the complexing of metal ions in solution, particularly when water contaminated with heavy metal ions is used. Indeed, water contaminated with heavy metal ions is often the cause of re-soiling on fabrics during the rinse.

SUMMARY OF THE INVENTION

The present invention provides a rinse-added fabric treatment composition that is useful for increasing the amount of laundry residue that may be removed from laundered fabrics in an aqueous rinse bath solution. The composition comprises a rinse aid and is characterized by the fact that when the composition is diluted in an aqueous rinse bath solution, that rinse bath solution is capable of removing a greater quantity of laundry residue relative to a rinse bath solution consisting only of water. Rinse aids that are useful for increasing the amount of laundry residue removed from laundered fabrics include a pH control agent containing an acid for depressing the pH of the rinse bath below about 6.5, a suds suppression system having an anti-foaming agent, a metal ion control agent, a crystal growth inhibitor, a dispersant polymer, a detergent builder, or a combination thereof. Optionally, the compositions may also contain stabilizers, colorants, odor control agents and solvents amongst other optional materials.

In a process aspect of the present invention, various methods for increasing the rinse capacity of an aqueous rinse bath solution for removing laundry residue from laundered fabrics are provided. These methods comprise the steps of providing a composition of the present invention and dispensing an effective amount of the composition in an aqueous rinse bath solution. Manipulating or agitating the fabrics in the rinse solution will further improve the removal of laundry residue from the laundered fabrics.

In a further process aspect of the present invention, various methods for improving the whiteness, softness of fabrics as well as the removal of certain types of stains from fabrics are also provided. These methods comprise the steps of providing a composition of the present invention and dispensing an effective amount of the composition in an aqueous rinse bath solution. Manipulating or agitating the fabrics in the rinse solution will further improve the whiteness, softness and stain removal benefits on the fabrics.

In yet another aspect of the present invention, a rinse bath solution with increased rinse capacity is provided. A rinse bath solution of the present invention comprises water and an effective amount of a fabric treatment composition of the present invention. The rinse bath solution may contain a pH control agent, suds suppression system having an anti-foaming agent, a metal ion control agent, a crystal growth inhibitor, a dispersant polymer, a detergent builder, or a combination thereof. Optionally, the rinse bath solution may also contain stabilizers, colorants, odor control agents and solvents. The rinse bath solution may optionally have a pH of less than about 6.5, preferably less than about 5.75 and even more preferably less than about 5.

The present invention also relates to a rinse-added fabric treatment composition which reduces the surfactant residue on a fabric. The composition includes from about 0.05% to about 10% of a residue reduction agent, a suds suppresser and the balance adjunct ingredients. The residue reduction agent is selected from a cationic residue reduction agent, a zwitterionic residue reduction agent, and a combination thereof. Moreover, said composition is especially effective on removing anionic surfactant residue which is commonly left on or in fabric after laundering with a laundry detergent composition.

The present invention further provides a composition for reducing surfactant residue on fabric previously washed with detergent and more specifically detergent surfactants. The composition includes a suds suppressing system and a residue reduction agent selected from a cationic residue reduction agent, a zwitterionic residue reduction agent, and a combination thereof.

The present invention also relates to methods for reducing surfactant residue on a fabric, such as via a chaperone mechanism. Such a method includes the steps of providing a fabric which contains surfactant residue, providing a rinse-added fabric treatment composition, and adding the rinse-added fabric treatment composition to water to form a rinse bath solution. The rinse-added fabric treatment composition contains a residue reduction agent which has a hydrophilic portion and a surfactant-attracting portion selected from a hydrophobic moiety, a charged moiety, and a combination thereof. The fabric is then contacted with the rinse bath solution to form a non-covalent bond between the surfactant residue and the surfactant-attracting portion. Then, the surfactant residue on the fabric is reduced by pulling the residue reduction agent and the non-covalently bonded surfactant residue from the fabric and into the rinse bath solution via the hydrophilic portion.

The present invention also relates to a method for reducing the amount of water used in the rinsing step of a laundry process which includes the steps of providing a rinse-added fabric treatment composition, providing a fabric comprising surfactant residue, adding the rinse-added fabric treatment composition to water to form a rinse bath solution, and rinsing the fabric in the rinse bath solution. In such a process, the rinse water reduction is at least about 25%, as measured by the rinse water reduction test. Such a method may conserve significant amounts of water, especially when taking into consideration the large amount of fabrics which are washed every day.

The present invention also relates to a kit for improving the rinsing capacity of water which includes a rinse-added fabric treatment composition containing a rinse aid, and an instruction set. Such a kit may significantly reduce the amount of effort, water, and energy used in a rinsing process.

Accordingly, it has now been found that a rinse-added fabric treatment composition may significantly reduce surfactant residue, and may significantly reduce water consumption by reducing the need to repeatedly rinse a fabric with clean water.

These and other features, aspects, advantages, and variations of the present invention, and the embodiments described herein, will become evident to those skilled in the art from a reading of the present disclosure with the appended claims, and are covered within the scope of these claims.

BRIEF DESCRIPTION OF THE DRAWINGS

FIGURE is an example of a plot indicating the time delay (t-lag) in crystal formation afforded by a hypothetical crystal growth inhibitor.

DETAILED DESCRIPTION OF THE INVENTION

All percentages, ratios and proportions herein are by weight, unless otherwise specified. All temperatures are in degrees Celsius (° C.) unless otherwise specified. All documents cited are incorporated herein by reference in their entireties. Citation of any reference is not an admission regarding any determination as to its availability as prior art to the claimed invention.

As used herein, the term "alkyl" means a hydrocarbyl moiety, which is straight or branched, saturated or unsaturated. Unless otherwise specified, alkyl moieties are preferably saturated or unsaturated with double bonds, preferably with one or two double bonds. Included in the term "alkyl" is the alkyl portion of acyl groups.

As used herein, "comprising" means that other steps and other ingredients which do not affect the end result can be added. This term encompasses the terms "consisting of" and "consisting essentially of".

As used herein, the term "fabric article" means any fabric, fabric-containing, or fabric-like item that is laundered, conditioned, or treated on a regular, or irregular basis. Non-limiting examples of a fabric article include clothing, curtains, bed linens, wall hangings, textiles, cloth, etc. Preferably, the fabric article is a woven article, and more preferably, the fabric article is a woven article such as clothing. Furthermore, the fabric article may be made of natural and artificial materials, such as cotton, nylon, rayon, wool, silk, polycotton, polyester, etc.

As used herein, the term "laundry residue" means any material that may be present either on the fabrics or in the wash liquor during the wash cycle of the laundering process and that is carried over with the laundered fabrics into the rinse bath solution. Thus, "laundry residue" includes but is not limited to, residual soils, particulate matter, detergent surfactants, detergent builders, bleaching agents, metal ions, lipids, enzymes and any other materials that may have been present in the wash cycle solution. Furthermore, excess laundry liquor may be squeezed, wrung, or spun out of a fabric prior to remove excess laundry residue, prior to adding the fabric to the rinse bath solution. However, such laundry residue is not otherwise removed (i.e., rinsed out of the fabric with water) prior to adding the fabric to a rinse bath solution. Preferably, laundry residue includes "surfactant residue", which means that a surfactant material that may be present either on the fabrics or in the wash liquor during the wash cycle of the laundering process and that is carried over with the laundered fabrics into the rinse bath solution. Surfactant residue is removably-attached to the fabric surface and/or fabric fibers via hydrophilic attractions, calcium bridging, and/or other types of weak, non-covalent bonds.

As used herein, "rinse bath solution" is the solution used to rinse the fabrics subsequent to their washing. The rinse bath solution may be used in an automated or non-automated washing machine, or in the case of hand washing, may be used in a simple container such as a basin or bucket. The rinse bath solution is initially water before the laundered fabrics and accompanying laundry residue and/or the rinse-added fabric treatment composition are introduced.

I. Rinsing Capacity

Rinsing capacity is defined herein as a measure of the ability of a rinse bath solution to remove laundry residue from laundered fabrics. For purposes of the present invention, the rinsing capacity of a rinse bath solution consisting solely of water is 1. Therefore, the rinsing capacity of any solution is its rinsing potential relative to the rinsing potential of water. A rinse cycle using a rinse bath solution having a rinsing capacity of 2 is capable of removing a quantity of laundry residue from laundered fabrics that would have required two rinse cycles in a rinse bath solution consisting solely of water.

The specific rinse cycle used to determine the rinsing capacity of a given rinse bath solution relative to water is not critical. However, in making such a determination, the same source and volume of water (i.e. 10–20 L depending on the method of rinsing), the same rinsing times (i.e. anywhere from 5 to 10 minutes should be sufficient), the amount of agitation, and substantially the same quantity of laundered fabrics containing relatively the same quantity of laundry residue should be used in comparing the rinse bath solutions.

Likewise, a variety of conventional methods may be used to calculate the amount of residue deposited on fabric or suspended in a given solution. One method that will provide a total mass for the fabric and laundry residue deposited thereon involves the incineration of the fabrics and the determination of the mass from the resulting ash. Alternatively, the concentration of laundry residue or of a particular component of the laundry residue in a solution may be compared using a variety of analytical methods. For instance, detergent surfactants are frequently the largest component of the laundry residue that is transferred with the fabrics to the rinse bath. The concentration of one or more of these detergent surfactants may be used to determine the relative efficiencies of the rinse bath solutions. The concentration of such surfactants may be determined using a variety of analytical methods, including employing $C_{14}$ radiolabeling of surfactants.

Thus, for purposes of measuring the rinsing capacity of the rinse-added fabric treatment composition herein, 20 ml of the rinse-added fabric treatment composition is added to 10 L of water having a hardness of 16 grains per gallon (4.2 grains per liter), to form a rinse bath solution in a rinsing basin. A polyester shirt containing 300 μg anionic surfactant (linear alkyl benzene sulfonate) residue per gram of fabric (as measured according to a $C_{14}$ radio-labeled surfactant test method) is added to the rinsing basin, and agitated in the basin for 5 minutes. After soaking, the polyester shirt is removed, wrung out, dried, and the remaining anionic surfactant residue measured using the same test method.

Concurrently, a comparative polyester shirt also containing 300 μg of anionic surfactant is also rinsed in 10.02 L of water by agitating it for 5 minutes, removing it, wringing it out, drying it, and then measuring the remaining surfactant residue per gram of fabric. The same shirt is then subjected to repeated rinsing cycles with new volumes of water (i.e., after a rinsing cycle the water used is not reused in the next rinsing cycle), and the remaining surfactant residue measured, to determine a set of datapoints which are then plotted on a graph.

The surfactant residue on the shirt rinsed with the rinse-added fabric treatment composition of the invention is then compared to the graph to determine the rinsing capacity of the rinse-added fabric treatment composition.

Furthermore, the rinsing capacity may differ according to the type of fabric used. Thus, for the purposes of determining the rinsing capacity of the present process, 100% polyester fabric is employed.

When used according to the methods herein, the rinse-added fabric treatment composition of the present invention typically provides a rinsing capacity to remove surfactant residue of at least about 2, preferably from about 2.5 to about 10, and more preferably from about 3 to about 7.

By increasing the rinsing capacity of a rinse bath solution, it is possible to remove greater quantities of laundry residue in a given rinse cycle. This results in fewer and perhaps shorter rinse cycles, conserving time, energy and water during the rinsing process as well as the overall laundering operation.

II. Rinse Water Reduction Test

The amount of water used in the rinsing step can be quantified by the following test method:

1. Prepare 10 identical shirts (100% polyester) which have been washed in the same detergent composition, in a commercial washing machine. All 10 shirts should be spun-dried in the washing machine to the same level of dryness. Divide this into 2 sets of 5 shirts.
2. Prepare a rinse bath solution in a first rinsing basin containing the appropriate dilution of rinse-added fabric treatment composition, so as to form a total of 10 L of rinse bath solution.
3. Prepare a second rinsing basin containing 10 L of water.
4. Begin rinsing the first set of 5 shirts by hand in the first rinsing basin by agitating them in the rinsing bath solution for 10 minutes. If, after agitating for 10 minutes, A) the rinse bath solution is clear, and B) no more suds are released from the shirts when they are agitated in the rinsing bath solution, then the rinsing is complete; proceed to the next step. This is because consumers typically look to both rinse bath solution clarity and suds release/removal to indicate when the last rinsed shirt is sufficiently free of surfactant residue.

If either the rinse bath solution is not clear, or if suds are still being released from the shirts, then empty out the first rinsing basin and prepare a new rinse bath solution as described in step 2. Keep track of how many 10 L rinsing basins of rinse bath solution are prepared and used. Multiply the number of rinsing basins used by 10 L to find the "total water of test composition".

5. Repeat Step 4 with the second set of shirts, except in the second rinsing basin full of water. Factors such as the amount of water, time, and the degree of agitation must be substantially the same so as to provide comparable results. Replace the water, as needed, to achieve the same level of rinse bath solution clarity and suds release as observed for the test composition. Keep track of how many 10 L rinsing basins of water are prepared and used. Multiply the number of rinsing basins used by 10 L to find the "total water of control".
6. Compare the total amount of water used by the test rinse-added fabric treatment composition and the control water composition. The amount of reduction of water used in the rinsing step when employing a rinse-added fabric treatment composition according to the present invention, as compared to the control water composition, can thus be calculated as:

$$\text{Rinse Water Reduction} = \left[1 - \frac{(\text{Total water of test composition})}{(\text{Total water of control})}\right] * 100$$

The rinse water reduction according to the method of the present invention is at least about 25%, preferably from about 25% to about 90%, more preferably from about 50% to about 85%, even more preferably from about 60% to about 80%, as compared to when just water is used.

III. Rinse Aids

The compositions of the present invention comprise an effective amount of a rinse aid such that when the composition is diluted in a rinse bath solution, the rinsing capacity of that solution is greater than 1, preferably greater than about 2, and even more preferably is greater than about 2.5. The preferred rinse aids include pH control agents having an acid to yield a rinse bath solution having a pH less than about 6.5, a suds suppression system having an anti-foaming agent, a metal ion control agent, a crystal growth inhibitor, a dispersant, a detergent builder, a residue reduction agent, and a mixture thereof, preferably a pH control agent, a suds suppression system, a dispersant, a residue reduction agent, and a mixture thereof, and more preferably a pH control agent, a suds suppression system, and a residue reduction agent.

A. pH Control Agents

1) Acid

In a highly preferred aspect of the invention the compositions according to the present invention have a pH as a 0.2% solution in distilled water at 20° C. of less than 7, preferably from 3 to 6.5, most preferably from 4 to 6.5. The use of this acid pH range is desirable for the compositions as it enables the rejuvenation of the smoothness of the fabric as well as a stain removal performance, in particular of bleach sensitive stains.

The pH of the compositions may be adjusted by the use of various pH acidification agents. Preferred acidification agents include inorganic and organic acids including, for example, carboxylate acids, such as citric and succinic acids, polycarboxylate acids, such as polyacrylic acid, and also acetic acid, boric acid, malonic acid, adipic acid, fumaric acid, lactic acid, glycolic acid, tartaric acid, tartronic acid, maleic acid, their derivatives and any mixtures of the foregoing. A highly preferred acidification acid is citric acid which has the advantage of providing a rejuvenation of the natural smoothness of the fabric. A typical amount of acidifying agent is of from 0.1% to 50%, and preferably from 0.5 to 10% by weight of the composition.

2) pH Buffering Component

In order to maintain the desired pH range upon dilution of the composition, it may be beneficial to have a pH buffering agent. The problem of sustaining the pH within a desired range is most acute when the compositions are used in the rinse bath solution following the completion of the wash cycle. It is at this point that the laundered fabrics are impregnated with the detergent liquor, causing a degree of alkalinity within the rinse bath solution. A high level of alkalinity is not desired herein as it may provide a soapy feeling on the consumer's hands and fabrics, as well as inducing a carbonate deposition which contributes to the source of harshness on the fabrics. In addition, it is also possible that the pH of the composition and the rinse bath solution may become too low, dropping below the desired range.

Accordingly, a pH buffering component is an optional but preferred component for the compositions of the invention. The pH buffering component ensures that the pH of the composition is buffered to a pH value ranging from 3.0 to 7, and preferably from 4 to 6 after the composition has been diluted into 1 to about 10,000, preferably 1 to about 5,000, more preferably from 1 to about 300 to 1 to about 600 times its weight of water.

Suitable pH buffering components for use herein are selected from the group consisting of alkali metal salts of carbonates, preferably sodium bicarbonate, polycarbonates, sesquicarbonates, silicates, polysilicates, borates, metaborates, phosphates, preferably sodium phosphate such as sodium hydrogenophosphate, polyphosphate like sodium tripolyphosphate, aluminates, and mixtures thereof, and preferably are selected from alkali metal salts of carbonates, phosphates, and mixtures thereof. Optimum buffering system are characterized by good solubility, even in very hard water conditions (e.g. 30 gpg). One less preferred buffering system is sodium tripolyphosphate (STPP) at a high level, i.e. 18% by weight of the composition. Indeed, it has been found that STPP reverts in the presence of water and temperature. Not to be bound by theory, it is believed these products of reversion give precipitates in hard water. Of course, a lower level may be used herein without encountering the above problem.

The treatment compositions herein will contain an amount of pH buffering component of from 0.1% to 50%, preferably from 0.2% to 20%, and more preferably in an amount of from 0.4% to 10% by weight of the composition.

B. Suds Suppression System

In a preferred embodiment of the invention, the reduction of the suds is achieved by use of a suds suppressing system. The suds suppressing system is preferably present at a level of from 0.01% to 99%, more preferably from 0.1% to 50%, most preferably from 1.0% to 5% by weight of the composition. Such suds suppressing systems are particularly desired components of the compositions of the invention when the detergent liquor is made of detergent which comprises a surfactant system that comprises high foaming surfactant, such as the conventional $C_{11}$–$C_{18}$ alkyl benzene sulfonates ("LAS"). More specifically, when utilized as suds suppressers, the monocarboxylic fatty acids and salts thereof, will typically be present up to about 10%, and preferably from about 3% to about 7%, by weight of the composition. Silicone antifoam compounds are typically utilized in amounts up to about 10%, preferably from about 0.05% to about 6%, and more preferably from about 0.1% to about 5%, by weight of the composition, although higher amounts may be used. This upper limit is practical in nature, due primarily to concern with minimizing costs and due to the surprising effectiveness of lower levels of silicone antifoam compound to control the sudsing profile. As used herein, the silicone antifoam compound weight percentage includes any silica that may be utilized in combination with polyorganosiloxane, as well as any adjunct materials that may be utilized.

A wide variety of materials may be used as suds suppressers, and suds suppressers are well known to those skilled in the art. See, for example, Kirk Othmer Encyclopedia of Chemical Technology, Third Edition, Volume 7, pages 430–447 (John Wiley & Sons, Inc., 1979).

Suitable suds suppressing systems for use herein may comprise essentially any known antifoam compound, including, for example a silicone antifoam compound, an alcohol antifoam compound like the 2-alkyl alcanol antifoam compounds, a fatty acid, a paraffin antifoam compound, polyethylene glycol derivatives and mono-alkyl quaternary ammonium compounds, and mixtures thereof.

By antifoam compound it is meant herein any compound or mixtures of compounds which act such as to depress the foaming or sudsing produced by a solution of a detergent composition, particularly in the presence of agitation of that solution.

However, from a cost, solubility, and consumer benefit standpoint, a preferred suds suppression system useful herein is selected from the group consisting of a silicone antifoam compound, monocarboxylic fatty acid antifoam compound, a monocarboxylic fatty acid salt antifoam compound, and a mixture thereof, and is more preferably selected from the group consisting of a silicone antifoam compound and a mixture thereof. Without intending to be limited by theory, it is believed that a silicone antifoam compound is especially preferred, as they are generally more effective at reducing the surface tension at the air-water interface, while not detrimentally affecting the benefit of the residue reduction agent (if present) at the fabric-water interface.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types like the polyorganosiloxane oils, such as polydimethyl-siloxane, dispersions or emulsions of polyorganosiloxane oils or resins, and combinations of polyorganosiloxane with silica particles wherein the polyorganosiloxane is chemisorbed or fused onto the silica. Silicone suds suppressers are well known in the art and are, for example, disclosed in U.S. Pat. No. 4,265,779, issued May 5, 1981 to Gandolfo, et al., and European Patent Application No. 89307851.9, published Feb. 7, 1990, by Starch, M. S. Other silicone suds suppressers are disclosed in U.S. Pat. No. 3,455,839 to Rauner, issued Jul. 15, 1969, which relates to compositions and processes for defoaming aqueous solutions by incorporating therein small amounts of polydimethylsiloxane fluids. Mixtures of silicone and silanated silica are described, for instance, in German Patent Application DOS 2,124,526 to Bartolotta and Eymery issued Jun. 28, 1979. Silicone defoamers and suds controlling agents in granular detergent compositions are disclosed in U.S. Pat. No. 3,933,672 to Bartolotta, et al., issued Jan. 20, 1976, and in U.S. Pat. No. 4,652,392 to Baginski, et al., issued Mar. 24,1987.

An exemplary silicone based suds suppresser for use herein is a suds suppressing amount of a suds controlling agent consisting essentially of:

(i) polydimethylsiloxane fluid having a viscosity of from about 20 cps. to about 1,500 cps. at 25° C.;

(ii) from about 5 to about 50 parts per 100 parts by weight of (i) of siloxane resin composed of $(CH_3)_3SiO_{1/2}$ units of $SiO_2$ units in a ratio of from $(CH_3)_3$ $SiO_{1/2}$ units and to $SiO_2$ units of from about 0.6:1 to about 1.2:1; and (iii) from about 1 to about 20 parts per 100 parts by weight of (i) of a solid silica gel.

In a preferred silicone antifoam compound used herein, the solvent for a continuous phase is made up of certain polyethylene glycols or polyethylene-polypropylene glycol copolymers or mixtures thereof (preferred), or polypropylene glycol. The primary silicone antifoam compound is branched/crosslinked and preferably not linear.

The silicone antifoam compound preferably includes (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than about 2 weight %; and without polypropylene glycol. See also U.S. Pat. No. 4,978,471 to Starch, issued Dec. 18, 1990, and U.S. Pat. No. 4,983,316 to Starch, issued Jan. 8, 1991, and U.S. Pat. No. 5,288,431 to Huber, et al., issued Feb. 22, 1994.

The silicone antifoam compound herein preferably includes polyethylene glycol and a copolymer of polyethylene glycol/polypropylene glycol, all having an average molecular weight of less than about 1,000, and preferably of from about 100 to about 800. The polyethylene glycol and polyethylene/polypropylene copolymers herein have a solubility in water at room temperature of more than about 2 weight %, and preferably more than about 5 weight %. The preferred solvent herein is polyethylene glycol having an average molecular weight of less than about 1,000, more preferably of from about 100 to about 800, and more preferably of from about 200 to about 400, and a copolymer of polyethylene glycol/polypropylene glycol, preferably PPG 200/PEG 300. Preferably, the suds suppresser has a weight ratio of polyethylene glycol:copolymer of polyethylene-polypropylene glycol of from about 1:1 to about 1:10, and more preferably of from about 1:3 to about 1:6. Alternatively, these polymeric suds suppressers may be present in place of a silicone antifoam compound. Specifically, a polyethylene glycol or derivative thereof may be used as the suds suppresser without a silicone containing compounds present. Commercially available PEG derivatives that may be used as an anti-foaming agent in the suds suppression systems of the present invention include Ablunol™ 200MO, 400MS and 600ML from Taiwan Surfactants; Carbowax Sentry™ PEG 1000 or 3350 available from Union Carbide; Pluronix™, Meroxapol 105, Pluracol W5100N and Poloxamer 108 available from BASF; and Radiasurf™ 7423 available from Fina Chemicals.

A highly preferred silicone antifoam compound mixture is DOW CORNING® 2-3000 ANTIFOAM, available from Dow Corning (Midland, Mich., USA), having a viscosity of about 3500 cps, and DOW CORNING® 544 ANTIFOAM, DOW CORNING® 1400 ANTIFOAM, DOW CORNING® 1410 ANTIFOAM, Silicone 3565, and other similar products available from Dow Corning. Other highly preferred suds suppressers useful herein include SE39 silicone gum and S-339 methyl siloxane antifoaming agents which are commercially available from Wacker-Chemie GmbH (Burghausen, Germany). In addition, a silicone antifoam compound may provide a thickening benefit without adversely affecting the dissolution profile of the rinse-added fabric treatment composition. This is especially useful where a high viscosity rinse-added fabric treatment composition is desired.

Examples of suitable silicone antifoam compounds are the combinations of polyorganosiloxane with silica particles commercially available from Dow Corning, Wacker-Chemie and General Electric.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressing system typically have hydrocarbyl chains of 10 to about 24 carbon atoms, preferably 12 to 18 carbon atoms like the tallow amphopolycarboxyglycinate commercially available under the trade name TAPAC. Suitable salts include the alkali metal salts such as sodium, potassium, and lithium salts, and ammonium and alkanolammonium salts.

Other suitable antifoam compounds include, for example, high molecular weight hydrocarbons such as paraffin, light petroleum odorless hydrocarbons, fatty esters (e.g. fatty acid triglycerides, glyceryl derivatives, polysorbates), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl phosphates such as monostearyl alcohol phosphate ester and monostearyl di-alkali metal (e.g., K, Na, and Li) phosphates and phosphate esters, quaternary ammonium compounds, di-alkyl quaternary compounds, poly functionalised quaternary compounds, and nonionic polyhydroxyl derivatives. The hydrocarbons, such as paraffin and haloparaffin, can be utilized in liquid form. The liquid hydrocarbons will be liquid at room temperature and atmospheric pressure, and will have a pour point in the range of about −40° C. and about 5° C., and a minimum boiling point not less than 110° C. (atmospheric pressure). It is also known to utilize waxy hydrocarbons, preferably having a melting point below about 100° C. Hydrocarbon suds suppressers are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin", as used in this suds suppresser discussion, is intended to include mixtures of true paraffins and cyclic hydrocarbons.

Copolymers of ethylene oxide and propylene oxide, particularly the mixed ethoxylated/propoxylated fatty alcohols with an alkyl chain length of from 10 to 16 carbon atoms, a degree of ethoxylation of from 3 to 30 and a degree of propoxylation of from 1 to 10, are also suitable antifoam compounds for use herein. An example of an ethoxylated fatty alcohol for use as an antifoaming agent in the compositions of the present invention is Lipocol™ O-10 available from Lipo Chemicals. A commercially available block copolymer useful as an anti-foaming agent is Prox-onic™ EP 2080-1 available from Protex International.

Other suds suppressers useful herein comprise the secondary alcohols (e.g., 2-alkyl alkanols as described in DE 40 21 265) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. Examples include the 2-Hexyldecanol commercially available under the trade name ISOFOL16, 2-Octyldodecanol commercially available under the trade name ISOFOL20, and 2-butyl octanol, available under the trade name ISOFOL 12 from Condea. Adol 80 is another oleyl alcohol, commercially available from The Procter & Gamble Company which is another useful anti-foaming agent. A preferred alcohol is 2-butyl octanol, which is available from Condea under the trademark ISOFOL 12. Mixtures of secondary alcohols are available under the trademark ISALCHEM 123 from Enichem. Mixed suds suppressers typically comprise mixtures of alcohol: silicone at a weight ratio of 1:5to 5:1.

Other suitable antifoams, described in the literature such as in Hand Book of Food Additives, ISBN 0-566-07592-X, p804, are selected from dimethicone, poloxamer, polypropyleneglycol, tallow derivatives, and mixtures thereof.

To secure optimum rinse bath solution clarity with very limited residual materials on the surface of the rinse bath solution, it is preferred that the composition is substantially free (i.e. less than 1.5% by weight of the composition) and preferably free of quaternary ammonium compounds having di-long chain such as ditallow dimethyl ammonium chloride (DTDMAC), C11–C22 diakylester quaternary ammonium compound, in particular, the dimethyl bis(steroyl oxyethyl) ammonium chloride or the 1,2-di(tallowyloxy-oxo)-3-N,N,N-trimethylammoniopropane chloride, so that the clarity of the rinse bath solution is not affected. Indeed, although they have effective suds suppressing properties, their water-insoluble properties renders the solution cloudy, and even turbid.

This is not to say that the mono-alkyl derivatives of such quaternary ammonium compounds should not be used. In fact, these derivatives tend to have the suds suppressing effect of their dialkyl counterparts, but also tend to be more water soluble. Non-limiting examples of such suds suppressers includes dodecyltrimethylammonium chloride, dodecyl (hydroxyethyldimethyl) ammonium chloride, cethyltrimethylammonium chloride and cethyl ((hydroxyethyldimethyl) ammonium chloride. Those skilled in the art will recognize that other anions such as bromide and hydrogen sulfate may be used in place of the chloride in these compounds.

Preferred among the suds suppressing systems described above are the silicone antifoams, in particular the combinations of polyorganosiloxane with silica particles.

C. Metal Ion Control Agents

Heavy metal ion (HMI) sequestrants are useful components herein for optimum whiteness and HMI control. By heavy metal ion sequestrants it is meant components which act to sequester (chelate) heavy metal ions. These components may also have calcium and magnesium chelation capacity, but preferentially they bind heavy metal ions such as iron, manganese and copper. These compounds are even more desired when the water is a tap water of low quality and consequently that which comprises a high level of HMI.

Heavy metal ion sequestrants are preferably present at a level of from 0.005% to 20%, more preferably from 0.1% to 10%, most preferably from 0.2% to 5% by weight of the compositions.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the heavy metal ion sequestrant is preferably at least 1:1.

Suitable heavy metal ion sequestrants for use herein include the organo aminophosphonates, such as the amino alkylene poly (alkylene phosphonates) and nitrilo trimethylene phosphonates. Preferred organo aminophosphonates are diethylene triamine penta (methylene phosphonate) and hexamethylene diamine tetra (methylene phosphonate).

Other suitable heavy metal ion sequestrants for use herein include nitrilotriacetic acid and polyaminocarboxylic acids such as ethylenediaminotetracetic acid, ethylenetriamine pentacetic acid, or ethylenediamine disuccinic acid. A further suitable material is ethylenediamine-N,N'-disuccinic acid (EDDS), most preferably present in the form of its S,S isomer, which is preferred for its biodegradability profile.

Still other suitable heavy metal ion sequestrants for use herein are iminodiacetic acid derivatives such as 2-hydroxyethyl diacetic acid or glyceryl imino diacetic acid, described in EPA 317 542 and EPA 399 133.

D. Crystal Growth Inhibitors

For optimum whiteness and calcium control, the compositions of the present invention optionally comprise from about 0.005 to about 5%, more preferably from about 0.1% to about 1% of a crystal growth inhibitor as a rinse aid. The following "Crystal Growth Inhibition Test" is used to determine the suitability of a material for use as a crystal growth inhibitor.

Crystal Growth Inhibition Test (CGIT)

The suitability of a material to serve as a crystal growth inhibitor according to the present invention can be determined by evaluating in vitro the growth rate of certain inorganic micro-crystals. The procedure of Nancollas et al., described in "Calcium Phosphate Nucleation and Growth in Solution", *Prog. Crystal Growth Charact.*, Vol. 3, 77–102, (1980), incorporated herein by reference, is a method which is suitable for evaluating compounds for their crystal growth inhibition. The graph in the figure serves as an example of a plot indicating the time delay (t-lag) in crystal formation afforded by a hypothetical crystal growth inhibitor.

The observed t-lag provides a measure of the compound's efficiency with respect to delaying the growth of calcium phosphate crystal. The greater the t-lag, the more efficient the crystal growth inhibitor.

Crystal growth inhibitors which are suitable for use in the present invention have a t-lag of at least 10 minutes, preferably at least 20 minutes, more preferably at least 50 minutes, at a concentration of $1\times10^{-6}$M. Crystal growth inhibitors are differentiated form chelating agents by the fact that crystal growth inhibitors have a low binding affinity of heavy metal ions, i.e., copper. For example, crystal growth inhibitors have an affinity for copper ions in a solution of 0.1 ionic strength when measured at 25° C., of less than 15, preferably less than 12.

The preferred crystal growth inhibitors of the present invention are selected from the group consisting of carboxylic compounds, organic diphosphonic acids, organic monophosphonic acids, and mixtures thereof. The following are non-limiting examples of preferred crystal growth inhibitors.

1) Carboxylic Compounds

Non-limiting examples of carboxylic compounds which serve as crystal growth inhibitors include glycolic acid, polycarboxylic acids, polymers and co-polymers of carboxylic acids and polycarboxylic acids, and mixtures thereof. The inhibitors may be in the acid or salt form. Preferably the polycarboxylic acids comprise materials having at least two carboxylic acid radicals which are separated by not more than two carbon atoms (e.g., methylene units). The preferred salt forms include alkali metals; lithium, sodium, and potassium; and alkanolammonium. The polycarboxylates suitable for use in the present invention are further disclosed in U.S. Pat. No. 3,128,287, U.S. Pat. No. 3,635,830, U.S. Pat. No. 4,663,071, U.S. Pat. No. 3,923,679; U.S. Pat. No. 3,835,163; U.S. Pat. No. 4,158,635; U.S. Pat. No. U.S. Pat. No. 4,120,874 and U.S. Pat. No. 4,102,903, each of which is included herein by reference.

Further suitable polycarboxylates include ether hydroxypolycarboxylates, polyacrylate polymers, copolymers of maleic anhydride and the ethylene ether or vinyl methyl ethers of acrylic acid. Copolymers of 1,3,5-trihydroxybenzene, 2, 4, 6-trisulphonic acid, and carboxymethyloxysuccinic acid are also useful. Alkali metal salts of polyacetic acids, for example, ethylenediamine tetraacetic acid and nitrilotriacetic acid, and the alkali metal salts of polycarboxylates, for example, mellitic acid, succinic acid, oxydisuccinic acid, polymaleic acid, benzene 1,3,5-tricarboxylic acid, carboxymethyloxysuccinic acid, are suitable for use in the present invention as crystal growth inhibitors.

The polymers and copolymers which are useful as crystal growth inhibitors have a molecular weight which is preferably greater than about 500 daltons to about 100,000 daltons, more preferably to about 50,000 daltons.

Examples of commercially available materials for use as crystal growth inhibitors include, polyacrylate polymers Good-Rite® ex BF Goodrich, Acrysol® ex Rohm & Haas, Sokalan® ex BASF, and Norasol® ex Norso Haas. Preferred are the Norasol® polyacrylate polymers, more preferred are Norasol® 410N (MW 10,000) and Norasol® 440N (MW 4000) which is an amino phosphonic acid modified polyacrylate polymer, and also more preferred is the acid form of this modified polymer sold as Norasol® QR 784 (MW 4000) ex Norso-Haas.

Polycarboxylate crystal growth inhibitors include citrates, e.g., citric acid and soluble salts thereof (particularly sodium salt), 3,3-dicarboxy-4-oxa-1,6-hexanedioates and related compounds further disclosed in U.S. Pat. No. 4,566,984 incorporated herein by reference, $C_5$–$C_{20}$ alkyl, $C_5$–$C_{20}$ alkenyl succinic acid and salts thereof, of which dodecenyl succinate, lauryl succinate, myristyl succinate, palmityl succinate, 2-dodecenylsuccinate, 2-pentadecenyl succinate, are non-limiting examples. Other suitable polycarboxylates are disclosed in U.S. Pat. No. 4,144,226, U.S. Pat. No. 3,308,067 and U.S. Pat. No. 3,723,322, all of which are incorporated herein by reference.

2) Organic Diphosphonic Acids

Organic diphosphonic acid are also suitable for use as crystal growth inhibitors. For the purposes of the present invention the term "organic diphosphonic acid" is defined as "an organo-diphosphonic acid or salt which does not comprise a nitrogen atom". Preferred organic diphosphonic acids include $C_1$–$C_4$ diphosphonic acid, preferably $C_2$ diphosphonic acid selected from the group consisting of ethylene diphosphonic acid, α-hydroxy-2 phenyl ethyl diphosphonic acid, methylene diphosphonic acid, vinylidene-1,1-diphosphonic acid, 1,2-dihydroxyethane-1,1-diphosphonic acid, hydroxy-ethane 1,1 diphosphonic acid, the salts thereof, and mixtures thereof. More preferred is hydroxyethane-1,1-diphosphonic acid (HEDP).

3) Organic Monophosphonic Acids

Still useful herein as crystal growth inhibitors are the organic monophosphonic acids. Organo monophosphonic acid or one of its salts or complexes is also suitable for use herein as a CGI.

By organo monophosphonic acid it is meant herein an organo monophosphonic acid which does not contain nitrogen as part of its chemical structure. This definition therefore excludes the organo aminophosphonates, which however may be included in compositions of the invention as heavy metal ion sequestrants.

The organo monophosphonic acid component may be present in its acid form or in the form of one of its salts or complexes with a suitable counter cation. Preferably any salts/complexes are water soluble, with the alkali metal and alkaline earth metal salts/complexes being especially preferred.

A preferred organo-monophosphonic acid is 2-phosphonobutane-1,2,4-tricarboxylic acid commercially available from Bayer under the trade name of Bayhibit.

E. Dispersants

The rinse aids used in the compositions of the present invention may comprise a polymer dispersant for suspending materials in the rinse and inhibiting their deposition on the laundered fabrics.

Polymeric dispersing agents can advantageously be utilized at levels from about 0.1% to about 7%, by weight, in the compositions herein. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used alone or in combination with other builders (including lower molecular weight polycarboxylates) by crystal growth inhibition, particulate soil peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal and anti-redeposition agent. Typical molecular weight ranges for these purposes range from about 500 to about 100,000, preferably from about 1,000 to about 50,000, and more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

A group of preferred clay soil removal/anti-redeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti-redeposition agents known in the art can also be utilized in the compositions herein.

Another type of preferred anti-redeposition agent includes the carboxymethylcellulose (CMC) materials. These materials are well known in the art.

F. Builders

The rinse aid used in the compositions of the present invention may also comprise detergent builders to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least about 1% builder. Liquid formulations typically comprise from about 5% to about 50%, more typically about 5% to about 30%, by weight of detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a SiO2:Na2 O ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na-SKS-6 silicate builder does not contain aluminum. Na-SKS-6 has the delta-Na2SiO5 morphology form of layered silicate. It can be prepared by methods such as those described in German DE-A-3,417,649 and DE-A-3,742,043. SKS-6 is a highly preferred layered silicate for use herein, but other such layered silicates, such as those having the general formula NaMSix O2x+1.yH2 O wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-Na2SiO5 (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$Mz[(zAlO2)y].xH2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na12[(AlO2)12\ (SiO2)12].xH2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Citrate builders, e.g., citric acid and soluble salts thereof (particularly sodium salt), are polycarboxylate builders of particular importance for liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the compositions of the present invention are the 3,3-dicarboxy4-oxa-1,6-hexanedioates and the related compounds disclosed in U.S. Pat. No. 4,566,984, Bush, issued Jan. 28, 1986. Useful succinic acid builders include the C5–C20 alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Fatty acids, e.g., C12–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in formulations for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

G. Residue Reduction Agent

The residue reduction agent (RRA) useful herein interacts with surfactant residue and removes the surfactant residue from a fabric surface by pulling the surfactant residue into solution. The RRA is preferably tailored to the surfactant residue so as to include a "surfactant-attracting" portion which is attracted to the surfactant residue's ionic moieties, hydrophobic moieties, and/or alkoxylated moieties. Typically, the surfactant-attracting portion forms a non-covalent bond, such as an ion pair, with the surfactant residue. For example, in order to remove an anionic surfactant residue, a cationic RRA and/or a zwitterionic RRA may be useful herein, whereas to remove other types of surfactant residues, such as nonionic surfactant residues and cationic surfactant residues, a nonionic residue reduction agent and an anionic RRA may be respectively employed. Furthermore, the hydrophobic and/or hydrophilic moieties on the RRA may be tailored to the specific surfactant residue targeted for removal, thereby improving overall surfactant residue removal. Thus, the RRA herein typically contains a surfactant-attracting portion selected from a hydrophobic moiety, a charged moiety, and a combination thereof, preferably a charged moiety and more preferably a cationic moiety.

Since anionic surfactant residues cause the most concern for consumers, the RRA is preferably a cationic RRA and/or zwitterionic RRA. The cationic RRA and zwitterionic RRA useful herein typically have a quaternized nitrogen atom which is especially effective in forming an ion pair with an anionic surfactant residue. The RRA useful herein typically contains one or more alkoxylated repeating groups along with "short" and "longer" alkyl groups, preferably with two alkoxylated repeating groups, one short chain alkyl group, and one long chain alkyl group attached to the quaternized nitrogen. The cationic RRA and/or zwitterionic RRA useful herein thus preferably has the formula:

(Formula 1)

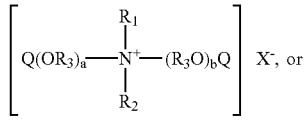

(Formula 2)

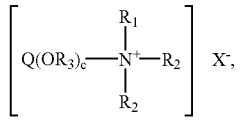

where $R_1$ is a saturated or unsaturated alkyl or aryl group having more than 4 carbon atoms, preferably more than about 10 carbon atoms, and more preferably from about 12 to about 25 carbon atoms. In addition, each $R_2$ is independently a $C_{1-4}$ alkyl group, preferably a $C_{1-2}$ alkyl group, and more preferably a methyl group, and each $R_3$ is independently a $C_{2-4}$ alkyl group preferably a $C_{2-3}$ alkyl group, and more preferably an ethyl group. In these formulas, a, b, and c denote average degrees of alkoxylation, and thus need not be integers. Thus, a and b are each independently from about 1 to about 20, preferably from about 3 to about 15, and more preferably from about 5 to about 10, while c is from about 1 to about 30, preferably from about 5 to about 20, and more preferably from about 10 to about 15. Each Q is independently selected from H, $SO_3^-$, $C_{1-4}$ alkyl, $CO_2^-$, $—(CH_2)_dPO_3M$, $—(CH_2)_dOPO_3M$, $—(CH_2)_dSO_3M$, $—CH_2CH(SO_3M)CH_2SO_3M$, or $—CH_2CH(SO_2M)CH_2SO_3M$, where d is from about 1 to about 5, preferably from about 1 to about 3, and more preferably from about 1 to about 2, and where M is a cation providing charge neutrality or a mixture thereof, preferably M is a water-soluble alkali metal ion, an alkali earth metal ion, or a mixture thereof, and more preferably M is sodium ion, potassium ion, or a mixture thereof. Preferably, Q is selected from the group consisting of $SO_3^-$, $CO_2^-$, H, and a mixture thereof; and more preferably at least one Q is $SO_3^-$. Finally, $X^-$ denotes an anion or a mixture thereof, preferably a water-soluble halide anion, and more preferably chloride ion, as needed, for providing charge neutrality.

The cationic RRA and/or the zwitterionic RRA may also have a plurality, and more preferably from about 2 to about 6 cationic nitrogen moieties. Without intending to be limited by theory, it is believed that such multiple cationic moieties further strengthen the attachment of the RRA to an anionic surfactant. More preferably, the plurality of cationic nitrogen moieties are linked by a linker such as a straight or branched hydrocarbon backbone, preferably ethylene, propylene, isopropylene, hexamethylene, 1,4-dimethylenebenzene, and/or 4,9-dioxadodecylene.

Thus, the cationic RRA and/or the zwitterionic RRA useful herein includes compounds of the formulas:

(Formula 3)

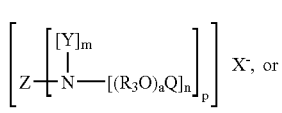

-continued (Formula 4)

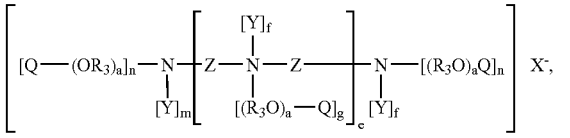

where Z is a straight or branched hydrocarbon backbone, preferably Z is selected from ethylene, propylene, isopropylene, hexamethylene, 1,4-dimethylenebenzene, and/or 4,9-dioxadodecylene. In Formula 3, p is from about 2 to about 6, preferably from about 2 to about 4. Each Y is independently selected from $R_1$ and $R_2$, as defined above for Formulas 1 and 2, and at least one Y is $R_1$. Also, each m and n are independently 1 or 2, where for each nitrogen moiety, the respective m+n=2 or 3. Furthermore, at least about 2 nitrogen moieties, preferably from about 2 to about 6 nitrogen moieties, and more preferably from about 2 to about 4 nitrogen moieties in Formula 3 are quaternized, such that their respective m+n=3. In Formula 3, $R_3$, Q, $X^-$ and a are defined as above, for Formulas 1 and 2.

In Formula 4, e represents the average number of linking groups and is from about 1 to about 6, preferably from about 1 to about 3, while each f is independently 0 or 1 and each g is independently 0 or 1. For each nitrogen moiety, the respective f+g=1 or 2. Furthermore, at least about 2 nitrogen moieties, preferably from about 2 to about 6 nitrogen moieties, and more preferably from about 2 to about 4 nitrogen moieties in Formula 4 are quaternized, such that their respective m+n =3, or their respective f+g=2. Except as specifically noted, $R_3$, Q, Y, $X^-$, a, m, and n, are as defined above for Formulas 1–3.

The cationic RRA is typically present as a water-soluble salt, preferably with any cationic moieties being charge-balanced with a water-soluble halide, and more preferably with any cationic moieties being charge-balanced with a chloride ion. Furthermore, any anionic moieties on a zwitterionic RRA, such as sulfate, are typically charge-balanced with a water-soluble alkali metal ion, alkali earth metal ion, or a mixture thereof, preferably a water-soluble alkali metal ion, and more preferably sodium ion, potassium ion, or a mixture thereof.

While examples of such compounds are known per se, they have not been previously employed to remove surfactant residues from a fabric. Without intending to be limited by theory, it is believed that the above cationic RRAs possess many qualities which make them particularly suited towards removing surfactant residue, and especially anionic surfactant residue from fabric. Specifically, the $R_1$ group is hydrophobic, which helps attract the RRA to the fabric. Once the RRA is near the fabric, it is believed that the charged, cationic nitrogen moiety is easily attracted to the anionic moiety of an anionic surfactant residue to form an associated ion pair. However, it is also believed that the alkoxy moieties are sufficiently hydrophilic so as to draw the cationic RRA and the accompanying surfactant residue into solution, and away from the fabric.

This "chaperone mechanism" for reducing surfactant residue by forming an ion pair and dragging the surfactant residue into solution is thus especially effective where the HLB of the RRA, according to the Davies Scale, is from about 25 to about 35, more preferably from about 28 to about 33. Without intending to be limited by theory, it is also believed that such an HLB is highly predictive of the efficacy of the RRA, as compounds having the above HLB are typically too hydrophilic to remain attached to a negatively-charged fabric fiber, and yet are sufficiently hydrophobic so as to be attracted to the liquid-fiber interface where it may then form an associated ion pair or other non-covalent bond with the surfactant residue and then chaperone it away from the fabric.

Therefore, a RRA having this HLB is sufficiently hydrophilic such that it does not typically deposit on fabric in appreciable amounts, as the present cationic RRA is intended to wash away in the rinse, and drag the anionic surfactant residue away from the fabric. This is significantly different from, for example, a cationic fabric softening active, whose HLB is significantly lower (i.e., more hydrophobic), and whose benefits are proportional to the amount of fabric softening active deposited onto the fabric.

Non-limiting, preferred examples of the RRA useful herein include PEG-15 cocomonium chloride (CAS # 61791-10-4) available as ETHOQUAD-C25 monochloride, from Akzo-Nobel Chemicals, Inc., Chicago, Ill., U.S.A.; PEG-17 cocomonium chloride (CAS # 61791-10-4) available as Berol 556, from Akzo-Nobel Chemicals, Inc., Chicago, Ill., U.S.A.; PEG-10 palmityldimethylammonium chloride; and PEG-96 dicocoylhexamethyenediammonium chloride, available from BASF Chemicals, Ludwigshafen, Germany. In addition, non-limiting, preferred examples of the RRA useful herein include forms of all these materials in which 0–100% of the available terminal EO moieties have been sulfated.

The RRA are typically present in the rinse-added fabric treatment composition at a level of from about 0.05% to 10%, preferably from about 0.5% to about 8%, and more preferably from about 0.75% to about 5%, by weight of the composition. However, it is recognized that in certain cases, such as concentrated compositions, higher or lower levels may also be employed herein.

Mixtures of the above RRAs are also useful herein, especially a combination of a cationic RRA and a zwitterionic RRA.

H. Mixtures of Rinse Aids

Mixtures of the various rinse aids discussed herein may be used to advantage and in some combinations are preferred in that they deliver greater increases in the rinsing capacity of the rinse bath solutions.

IV. Optionals

The fabric treatment compositions of the present invention may optionally, but preferably, will contain one or more of the following optional materials.

A. Stabilizers

In the presence of antifoam materials made of silicone, it is preferred to use a component that will provide a good stabilization of the silicone antifoam and hence of the composition. Typical levels of stabilizing agents are of from 0.01% to 20%, preferably from 0.5% to 8%, more preferably from 0.1% to 6% by weight of the composition.

Suitable stabilizing agents to be used herein include synthetic and naturally occurring polymers. Suitable stabilizing agents for use herein include xanthan gum or derivatives thereof, alginate or a derivative thereof, polysaccharide polymers such as substituted cellulose materials like ethoxylated cellulose, carboxymethylcellulose, hydroxymethylcellulose, hydroxypropyl cellulose, hydroxyethyl cellulose and mixtures thereof. Xanthan gum is a particularly preferred stabilizer.

Preferred stabilizing agents for use in the compositions of the invention are xanthan gum or derivatives thereof sold by the Kelco Division of Merck under the trade names KELTROL®, KELZAN AR®, KELZAN D35®, KELZAN S®, KELZAN XZ® and the like. Other particularly useful stabilizing agents are succinoglycan gum stabilizers, such as those available from Rhodia (St. Louis, Mo., USA).

Polymeric soil release agents are also useful in the present invention as stabilizing agents. These include cellulosic derivatives such as hydroxyether cellulosic polymers, ethoxylated cellulose, carboxymethylcellulose, hydroxymethylcellulose, hydroxypropyl cellulose, hydroxyethyl cellulose, and the like. Such agents are commercially available and include hydroxyethers of cellulose such as METHOCEL (Dow). Cellulosic soil release agents for use herein also include those selected from the group consisting of $C_1$–$C_4$ alkyl and C4 hydroxyalkyl cellulose; see U.S. Pat. No. 4,000,093, issued Dec. 28, 1976 to Nicol, et al.

B. Colorants & Brighteners

1) Dyes

The compositions of the present invention may optionally contain a dye or other colorant to improve the aesthetics of the composition. When present, a dye will preferably comprise less than about 0.001% by weight of the composition, and even more preferably less than about 0.0005%. Dyes are well known in the art and are available from a variety of commercial sources.

2) Brighteners

Commercial optical brighteners which may be useful in the present invention can be classified into subgroups, which include, but are not necessarily limited to, derivatives of stilbene, pyrazoline, coumarin, carboxylic acid, methinecyanines, dibenzothiphene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, available from Hilton-Davis, located in Italy; the 2-(4-styryl-phenyl)-2H-napthol[1,2-d]triazoles; 4,4'-bis-(1,2,3-triazol-2-yl)-stil-benes; 4,4'-bis(styryl)bisphenyls; and the aminocoumarins. Specific examples of these brighteners include 4-methyl-7-diethyl-amino coumarin; 1,2-bis(-venzimidazol-2-yl)ethylene; 1,3-diphenyl-phrazolines; 2,5-bis(benzoxazol-2-yl)thiophene; 2-styryl-napth-[1,2-d]oxazole; and 2-(stilbene-4-yl)-2H-naphtho-[1,2-d]triazole. See also U.S. Pat. No. 3,646,015, issued Feb. 29, 1972 to Hamilton. Anionic brighteners are preferred herein.

More specifically, the hydrophilic optical brighteners useful in the present invention are those having the structural formula:

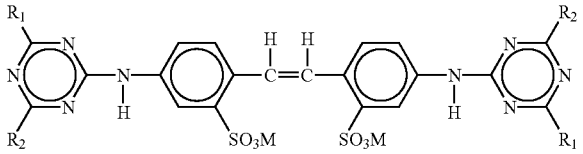

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the trade name Tinopal-UNPA-GX® by Ciba-Geigy Corporation. Tinopal-UNPA-GX is the preferred hydrophilic optical brightener useful in the rinse added compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX® by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX® by Ciba Geigy Corporation.

C. Odor Control Agent

Materials for use in odor control may be of the type disclosed in U.S. Pat. Nos. 5,534,165; 5,578,563; 5,663,134; 5,668,097; 5,670,475; and 5,714,137, Trinh et al. issued Jul. 9, 1996; Nov. 26, 1996; Sep. 2, 1997; Sep. 16, 1997; Sep. 23, 1997; and Feb. 3, 1998 respectively, all of said patents being incorporated herein by reference. Such compositions can contain several different optional odor control agents.

1) Pro-Perfumes

A pro-perfume may be useful in order to mask malodor. A pro-perfume is defined as a perfume precursor that releases a desirable odor and/or perfume molecule through the breaking of a chemical bond. Typically to form a pro-perfume, a desired perfume raw material is chemically linked with a carrier, preferably a slightly volatile or a sparingly volatile carrier. The combination results in a less volatile and more hydrophobic pro-perfume which results in increased deposition onto the fabric article. The perfume is then released by breaking the bond between the perfume raw material and the carrier either through a change in pH (e.g., due to perspiration during wear), air moisture, heat, enzymatic action and/or sunlight during storage or line drying. Thus, malodor is effectively masked by the release of the perfume raw material.

A perfume raw material for use in pro-perfumes are typically saturated or unsaturated, volatile compounds which contain an alcohol, an aldehyde, and/or a ketone group. The perfume raw materials useful herein include any fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

2) Cyclodextrin

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups.

The complexing between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels. As the water is being removed however, e.g., the fabric is being dried off, some low molecular weight organic amines and acids have more affinity and will complex with the cyclodextrins more readily.

The cavities within the cyclodextrin should remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85% (about 1.85 g in 100 grams of water) at room temperature. Beta-cyclodextrin is not preferred in compositions which call for a level of cyclodextrin higher than its water solubility limit. Non-derivatised beta-cyclodextrin is generally not preferred when the composition contains surfactant since it affects the surface activity of most of the preferred surfactants that are compatible with the derivatised cyclodextrins.

Cyclodextrins that are useful in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $—CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio) propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3–6-anhydrocyclomalto structure, e.g., the mono-3–6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. Nos. 3,426,011; 3,453,257; 3,453,258; 3,453,259; 3,453,260; 3,459,731; 3,553,191; 3,565,887; 4,535,152; 4,616,008; 4,678,598; 4,638,058; and 4,746,734.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrins is alpha-cyclodextrin and its derivatives thereof, gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

3) Low Molecular Weight Polyols

Low molecular weight polyols with relatively high boiling points, as compared to water, such as ethylene glycol, propylene glycol and/or glycerol are preferred optional ingredients for improving odor control performance of the composition of the present invention, especially when cyclodextrin is present. The incorporation of a small amount of low molecular weight glycols into the compositions of the present invention typically enhances the formation of the cyclodextrin inclusion complexes as the treated fabrics dry.

The polyols' ability to remain on the fabric for a longer period of time than water, as the fabrics dry, typically allows it to form ternary complexes with the cyclodextrin and some malodorous molecules. The addition of the glycols tends to fill up void space in the cyclodextrin cavity that is unable to be filled by some malodor molecules of relatively smaller sizes. Preferably the glycol used is glycerin, ethylene glycol, propylene glycol, diethylene glycol, dipropylene glycol or mixtures thereof, and more preferably ethylene glycol and/or propylene glycol. Cyclodextrins prepared by processes that result in a level of such polyols are highly desirable, since they can be used without removal of the polyols.

Some polyols, e.g., dipropylene glycol, are also useful to facilitate the solubilization of some perfume ingredients in the compositions of the present invention.

Typically, glycol is added to a composition of the present invention at a level of from about 0.01% to about 3%, by weight of the composition, preferably from about 0.05% to about 1%, more preferably from about 0.1% to about 0.5%, by weight of the composition. The preferred weight ratio of low molecular weight polyol to cyclodextrin is from about 2:1,000 to about 20:100, more preferably from about 3:1,000 to about 15:100, even more preferably from about 5:1,000 to about 10:100, and most preferably from about 1:100 to about 7:100.

4) Metal Salts

Optionally, but highly preferred, the present invention can include metallic salts for added odor absorption and/or antimicrobial benefit particularly when cyclodextrin is present. The metallic salts are selected from the group consisting of copper salts, zinc salts, and mixtures thereof.

Copper salts have some antimicrobial benefits. Specifically, cupric abietate acts as a fungicide, copper acetate acts as a mildew inhibitor, cupric chloride acts as a fungicide, copper lactate acts as a fungicide, and copper sulfate acts as a germicide. Copper salts also possess some malodor control abilities. See U.S. Pat. No. 3,172,817, which discloses deodorizing compositions for treating disposable articles, comprising at least slightly water-soluble salts of acylacetone, including copper salts and zinc salts, all of said patents are incorporated herein by reference.

The preferred zinc salts possess malodor control abilities. Zinc has been used most often for its ability to ameliorate malodor, e.g., in mouth wash products, as disclosed in U.S. Pat. Nos. 4,325,939, and 4,469,674. Highly-ionized and soluble zinc salts such as zinc chloride, provide the best source of zinc ions. Zinc borate functions as a fungistat and a mildew inhibitor, zinc caprylate functions as a fungicide, zinc chloride provides antiseptic and deodorant benefits, zinc ricinoleate functions as a fungicide, zinc sulfate heptahydrate functions as a fungicide and zinc undecylenate functions as a fungistat.

Preferably, the metallic salts are water-soluble zinc salts, copper salts or mixtures thereof, and more preferably zinc salts, especially $ZnCl_2$. These salts are preferably present in the present invention primarily to absorb amine and sulfur-containing compounds that have molecular sizes too small to be effectively complexed with the cyclodextrin molecules. Low molecular weight sulfur-containing materials, e.g., sulfide and mercaptans, are components of many types of malodors, e.g., food odors (garlic, onion), body/perspiration odor, breath odor, etc. Low molecular weight amines are also components of many malodors, e.g., food odors, body odors, urine, etc.

When metallic salts are added to the composition of the present invention they are typically present at a level of from about 0.1% to about 10%, preferably from about 0.2% to about 8%, more preferably from about 0.3% to about 5% by weight of the composition.

5) Soluble Carbonate and/or Bicarbonate Salts

Water-soluble alkali metal carbonate and/or bicarbonate salts, such as sodium bicarbonate, potassium bicarbonate, potassium carbonate, cesium carbonate, sodium carbonate, and mixtures thereof can be added to the composition of the present invention in order to help to control certain acid-type odors. Preferred salts are sodium carbonate monohydrate, potassium carbonate, sodium bicarbonate, potassium bicarbonate, and mixtures thereof. When these salts are used in a composition of the present invention, they are typically present at a level of from about 0.1% to about 5%, preferably from about 0.2% to about 3%, more preferably from about 0.3% to about 2%, by weight of the composition. When these salts are added to a composition of the present invention it is preferable that incompatible metal salts are not present in the composition. Preferably, when these salts are used the composition should be essentially free of zinc and other incompatible metal ions, e.g., Ca, Fe, Ba, etc. which form water-insoluble salts.

6) Enzymes

Enzymes can be used to control certain types of malodor, especially malodor from urine and other types of excretions, including regurgitated materials.

Proteases are especially desirable. The activity of commercial enzymes depends very much on the type and purity of the enzyme being considered. Enzymes that are water soluble proteases like pepsin, tripsin, ficin, bromelin, papain, rennin, and mixtures thereof are particularly useful. Non-limiting examples of suitable, commercially available, water soluble proteases are pepsin, tripsin, ficin, bromelin, papain, rennin, and mixtures thereof. Papain can be isolated, e.g., from papaya latex, and is available commercially in the purified form of up to, e.g., about 80% protein, or cruder, technical grade of much lower activity. Other suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE®. The preparation of this enzyme and analogous enzymes is described in British Patent Specification No. 1,243,784. Proteolytic enzymes suitable for removing protein-based stains that are commercially available include those sold under the trade names ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985); Protease B (see European Patent Application Serial No. 87303761.8, and European Patent Application 130,756); and proteases made by Genencor International, Inc., according to one or more of the following patents: U.S. Pat. Nos. 5,185,258, 5,204,015 and 5,244,791.

A wide range of enzyme materials and means for their incorporation into compositions are also disclosed in U.S. Pat. No. 3,553,139. Enzymes are further disclosed in U.S. Pat. No. 4,101,457 and in U.S. Pat. No. 4,507,219. Other enzyme materials useful for liquid formulations, and their incorporation into such formulations, are disclosed in U.S. Pat. No. 4,261,868. Enzymes can be stabilized by various techniques, e.g., those disclosed and exemplified in U.S. Pat. No. 3,600,319, European Patent Application Publication No. 0 199 405, and in U.S. Pat. No. 3,519,570.

Enzyme-polyethylene glycol conjugates are also preferred. Such polyethylene glycol (PEG) derivatives of enzymes, wherein the PEG or alkoxy-PEG moieties are coupled to the protein molecule through, e.g., secondary amine linkages. Suitable derivatization decreases immunogenicity, thus minimizes allergic reactions, while still maintaining some enzymatic activity. An example of protease-PEG's is PEG-subtilisin Carlsberg from *B. lichenniformis* coupled to methoxy-PEGs through secondary amine linkage, and is available from Sigma-Aldrich Corp., St. Louis, Mo.

7) Zeolites

When the clarity of the solution is not needed, and the solution is not sprayed on fabrics, other optional odor absorbing materials, e.g., zeolites and/or activated carbon, can also be used. A preferred class of zeolites is characterized as "intermediate" silicate/aluminate zeolites. The intermediate zeolites are characterized by $SiO_2/AlO_2$ molar ratios of less than about 10. Preferably the molar ratio of $SiO_2/AlO_2$ ranges from about 2 to about 10. The intermediate zeolites have an advantage over the "high" zeolites. The intermediate zeolites have a higher affinity for amine-type odors, they are more weight efficient for odor absorption because they have a larger surface area, and they are more moisture tolerant and retain more of their odor absorbing capacity in water than the high zeolites. A wide variety of intermediate zeolites suitable for use herein are commercially available as Valfor® CP301-68, Valfor® 300-63, Valfor® CP300-35, and Valfor® CP300-56, available from PQ Corporation, and the CBV100® series of zeolites from Conteka.

Zeolite materials marketed under the trade name Abscents® and Smellrite®, available from The Union Carbide Corporation and UOP are also preferred. These materials are typically available as a white powder in the 3–5 micron particle size range. Such materials are preferred over the intermediate zeolites for control of sulfur-containing odors, e.g., thiols, mercaptans.

8) Activated Carbon

The carbon material suitable for use in the present invention is the material well known in commercial practice as an absorbent for organic molecules and/or for air purification purposes. Often, such carbon material is referred to as "activated" carbon or "activated" charcoal. Such carbon is available from commercial sources under such trade names as; Calgon-Type CPG®; Type PCB®; Type SGL®; Type CAL®; and Type OL®. Activated carbon fibers and cloth may also be used in combination with the compositions and/or articles of manufacture disclosed herein to provide malodor removal and/or freshness benefits. Such activated carbon fibers and fabrics can be acquired from Calgon.

9) Perfume

As used herein the term "perfume" is used to indicate any odoriferous material that is subsequently released into the aqueous rinse bath solution and/or onto fabrics contacted therewith. The perfume will most often be liquid at ambient temperatures. A wide variety of chemicals are known for perfume uses, including materials such as aldehydes, ketones, and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Typical perfumes can comprise, for example, woody/earthy bases containing exotic materials such as sandalwood, civet and patchouli oil. The perfumes can be of a light floral fragrance, e.g. rose extract, violet extract, and lilac. The perfumes can also be formulated to provide desirable fruity odors, e.g. lime, lemon, and orange. Further, it is anticipated that so-called "designer fragrances" that are typically applied directly to the skin may be used in the compositions of the present invention. Likewise, the perfumes may be selected for an aromatherapy effect, such as providing a relaxing or invigorating mood. As such, any material that exudes a pleasant or otherwise desirable odor can be used as a perfume active in the compositions of the present invention.

10) Mixtures Thereof

Mixtures of the optional odor control agents described above are desirable, especially when the mixture provides control over a broader range of odors.

D. Solvents

Another optional, but preferred, ingredient is a liquid carrier. The liquid carrier employed in the instant compositions is preferably at least primarily water due to its low cost, relative availability, safety, and environmental compatibility. The level of water in the liquid carrier is preferably at least about 50%, most preferably at least about 60%, by weight of the carrier. Mixtures of water and low molecular weight, e.g., <about 200, organic solvent, e.g., lower alcohols such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

E. Soil Release Polymers

A soil release agent may optionally be incorporated into the compositions. Preferably, such a soil release agent is a polymer. One type of preferred soil release agent is a copolymer having random blocks of ethylene terephthalate and polyethylene oxide (PEO) terephthalate. The molecular weight of this polymeric soil release agent is in the range of from about 25,000 to about 55,000. Descriptions of such copolymers and their uses are provided in U.S. Pat. No. 3,959,230 to Hays, issued May 25, 1976 and U.S. Pat. No. 3,893,929 to Basadur issued Jul. 8, 1975.

Another preferred soil release polymer is a crystallizable polyester with repeating units of ethylene terephthalate containing from about 10% to about 15% by weight of ethylene terephthalate units together with from about 10% to about 50% by weight of polyoxyethylene terephthalate units that are derived from a polyoxyethylene glycol of average molecular weight of from about 300 to about 6,000. The molar ratio of ethylene terephthalate units to polyoxyethylene terephthalate units in such a crystallizable polymeric compound is between 2:1 and 6:1. Examples of this polymer include the commercially available materials Zelcon 4780® and Zelcon 5126 (from Dupont) and Milease T® (from ICI). See also U.S. Pat. No. 4,702,857, issued Oct. 27, 1987 to Gosselink.

Highly preferred soil release agents are polymers of the generic formula:

$$X-(OCH_2CH_2)_p(O-\overset{O}{\overset{\|}{C}}-R^{14}-\overset{O}{\overset{\|}{C}}-OR^{15})_u(O-\overset{O}{\overset{\|}{C}}-R^{14}-\overset{O}{\overset{\|}{C}}-O)(CH_2CH_2O)_n X$$

in which each X can be a suitable capping group, with each X typically being selected from the group consisting of H, and alkyl or acyl groups containing from about 1 to about 4 carbon atoms. p is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^{14}$ moieties are essentially 1,4-phenylene moieties. As used herein, the term "the $R^{14}$ moieties are essentially 1,4-phenylene moieties" refers to compounds where the $R^{14}$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene, and mixtures thereof. Alkylene and alkenylene moieties which can be partially substituted include 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^{14}$ moieties, the degree of partial substitution with moieties other than 1,4-phenylene should be such that the soil release properties of the compound are not adversely affected to any great extent. Generally the degree of partial substitution which can be tolerated will depend upon the backbone length of the compound, i.e., longer backbones can have greater partial substitution for 1,4-phenylene moieties. Usually, compounds where the $R^{14}$ comprise from about 50% to about 100% 1,4-phenylene moieties (from 0% to about 50% moieties other than 1,4-phenylene) have adequate soil release activity. For example, polyesters made with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^{14}$ moieties consist entirely of (i.e., comprise 100%) 1,4-phenylene moieties, i.e., each $R^{14}$ moiety is 1,4-phenylene.

For the $R^{15}$ moieties, suitable ethylene or substituted ethylene moieties include ethylene, 1,2-propylene, 1,2-butylene, 1,2-hexylene, 3-methoxy-1,2-propylene, and mixtures thereof. Preferably, the $R^{15}$ moieties are essentially ethylene moieties, 1,2-propylene moieties, or mixtures thereof. Inclusion of a greater percentage of ethylene moieties tends to improve the soil release activity of compounds.

Surprisingly, inclusion of a greater percentage of 1,2-propylene moieties tends to improve the water solubility of compounds. Therefore, the use of 1,2-propylene moieties or a similar branched equivalent is desirable for incorporation of any substantial part of the soil release polymer where the fabric care composition will be added to a laundry solution containing fabric softening actives. Preferably, from about 75% to about 100%, are 1,2-propylene moieties.

The value for each p is at least about 6, and preferably is at least about 10. The value for each n usually ranges from about 12 to about 113. Typically the value for each p is in the range of from about 12 to about 43.

A more complete disclosure of soil release agents is contained in U.S. Pat. No. 4,018,569, Trinh, Gosselink and Rattinger, issued Apr. 4, 1989; U.S. Pat. No. 4,661,267, Decker, Konig, Straathof, and Gosselink, issued Apr. 28, 1987; U.S. Pat. No. 4,702,857, Gosselink, issued Oct. 27, 1987; U.S. Pat. No. 4,711,730, Gosselink and Diehl, issued Dec. 8, 1987; U.S. Pat. No. 4,749,596, Evans, Huntington, Stewart, Wolf, and Zimmerer, issued Jun. 7, 1988; U.S. Pat. No. 4,808,086, Evans, Huntington, Stewart, Wolf, and Zimmerer, issued Feb. 24, 1989; U.S. Pat. No. 4,818,569, Trinh, Gosselink, and Rattinger, issued Apr. 4, 1989; U.S. Pat. No. 4,877,896, Maldonado, Trinh, and Gosselink, issued Oct. 31, 1989; U.S. Pat. No. 4,956,447, Gosselink et al., issues Sep. 11, 1990; U.S. Pat. No. 4,968,451, Scheibel and Gosselink, issued Nov. 6, 1990; and U.S. Pat. No. 4,976,879, Maldonado, Trinh, and Gosselink, issued Dec. 11, 1990.

Polymeric soil release actives useful in the present invention may also include cellulosic derivatives such as hydroxyether cellulosic polymers, and the like. Such agents are commercially available and include hydroxyethers of cellulose such as METHOCEL (Dow). Cellulosic soil release agents for use herein also include those selected from the group consisting of $C_1$–$C_4$ alkyl and $C_4$ hydroxyalkyl cellulose; see U.S. Pat. No. 4,000,093, issued Dec. 28, 1976 to Nicol, et al.

Soil release agents characterized by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (Germany).

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said soil release agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof.

The compositions of the present invention may also contain soil release and anti-redeposition agents such as water-soluble ethoxylated amines, most preferably ethoxylated tetraethylenepentamine. Exemplary ethoxylated amines are further described in U.S. Pat. No. 4,597,898 to VanderMeer, issued Jul. 1, 1986.

An hydrophobic dispersant is particularly suited for giving optimized stain removal benefit on clay. Accordingly, a preferred composition of the present invention comprises from about 0.1%, preferably from about 5%, more preferably form about 10% to about 80%, preferably to about 50%, more preferably to about 25% by weight, of a hydrophobic polyamine dispersant having the formula:

$$[(R^1)_2N-R]_w[\overset{\overset{R^1}{|}}{N}-R]_x[\overset{\overset{B}{|}}{N}-R]_yN(R^1)_2$$

wherein R, $R^1$ and B are suitably described in U.S. Pat. No. 5,565,145 Watson et al., issued Oct. 15, 1996 incorporated herein by reference, and w, x, and y have values which provide for a backbone prior to substitution of preferably at least about 1200 daltons, more preferably 1800 daltons.

$R^1$ units are preferably alkyleneoxy units having the formula:

$$-(CH_2CHR'O)_m(CH_2CH_2O)_nH$$

wherein R' is methyl or ethyl, m and n are preferably from about 0 to about 50, provided the average value of alkoxylation provided by m+n is at least about 0.5.

F. Scum Dispersants

The soil releasing materials described above will typically also act as scum dispersants. However, the compositions of the present invention may also contain a scum dispersant other than these soil release agents. The preferred scum dispersants herein are formed by highly ethoxylating hydrophobic materials. The hydrophobic material can be a fatty alcohol, fatty acid, fatty amine, fatty acid amide, amine oxide, quaternary ammonium compound, or the hydrophobic moieties used to form soil release polymers. The preferred scum dispersants are highly ethoxylated, e.g., more than about 17, preferably more than about 25, more preferably more than about 40, molecules of ethylene oxide per molecule on the average, with the polyethylene oxide portion being from about 76% to about 97%, preferably from about 81% to about 94%, of the total molecular weight.

The level of scum dispersant is sufficient to keep the scum at an acceptable, preferably unnoticeable to the consumer, level under the conditions of use. However, it is to be noted that excessive scum dispersant may adversely affect softening where the use of fabric softener actives are to be added to the rinse bath solution. Normally, the minimum amount of scum dispersant should be used to avoid adversely affecting softening properties. Preferred scum dispersants are: Brij 700®; Varonic U-250®; Genapol T-500®, Genapol T-800®; Plurafac A-79®; and Neodol 25–50®.

G. Preservatives

Optionally, but preferably, antimicrobial preservative can be added to the compositions of the present invention, especially if the stabilizing agent is made of cellulose. Indeed, the cellulose materials can make a prime breeding ground for certain microorganisms, especially when in aqueous compositions. This drawback can lead to the problem of storage stability of the solutions for any significant length of time. Contamination by certain microorganisms with subsequent microbial growth can result in an unsightly and/or malodorous solution. Because microbial growth in solutions is highly objectionable when it occurs, it is highly preferable to include an antimicrobial preservative, which is effective for inhibiting and/or regulating microbial growth in order to increase storage stability of the composition.

It is preferable to use a broad spectrum preservative, e.g., one that is effective on both bacteria (both gram positive and gram negative) and fungi. A limited spectrum preservative, e.g., one that is only effective on a single group of microorganisms, e.g., fungi, can be used in combination with a broad spectrum preservative or other limited spectrum preservatives with complimentary and/or supplementary activity. A mixture of broad spectrum preservatives can also be used. In some cases where a specific group of microbial contaminants is problematic (such as Gram negatives), aminocarboxylate chelators, such as those described hereinbefore, can be used alone or as potentiators in conjunction with other preservatives. These chelators which include, e.g., ethylenediaminetetraacetic acid (EDTA), hydroxyethylenediaminetriacetic acid, diethylenetriaminepentaacetic acid, and other aminocarboxylate chelators, and mixtures thereof, and their salts, and mixtures thereof, can increase preservative effectiveness against Gram-negative bacteria, especially Pseudomonas species.

Antimicrobial preservatives useful in the present invention include biocidal compounds, i.e., substances that kill microorganisms, or biostatic compounds, i.e., substances that inhibit and/or regulate the growth of microorganisms. Well known preservatives such as short chain alkyl esters of p-hydroxybenzoic acid, commonly known as parabens; N-(4-chlorophenyl)-N'-(3,4-dichlorophenyl) urea, also known as 3,4,4'-trichlorocarbanilide or triclocarban; 2,4,4'-trichloro-2'-hydroxy diphenyl ether, commonly known as triclosan are useful preservative in the present invention.

Still other preferred preservatives are the water-soluble preservatives, i.e. those that have a solubility in water of at least about 0.3 g per 100 ml of water, i.e., greater than about 0.3% at room temperature, preferably greater than about 0.5% at room temperature.

The preservative in the present invention is included at an effective amount. The term "effective amount" as herein defined means a level sufficient to prevent spoilage, or prevent growth of inadvertently added microorganisms, for a specific period of time. In other words, the preservative is not being used to kill microorganisms on the surface onto which the composition is deposited in order to eliminate odors produced by microorganisms. Instead, it is preferably being used to prevent spoilage of the solution in order to increase the shelf-life of the composition. Preferred levels of preservative are from about 0.0001% to about 0.5%, more preferably from about 0.0002% to about 0.2%, most preferably from about 0.0003% to about 0.1%, by weight of the usage composition.

The preservative can be any organic preservative material which will not cause damage to fabric appearance, e.g., discoloration, coloration, bleaching. Preferred water-soluble preservatives include organic sulfur compounds, halogenated compounds, cyclic organic nitrogen compounds, low molecular weight aldehydes, quaternary ammonium compounds, dehydroacetic acid, phenyl and phenolic compounds, and mixtures thereof. Non-limiting examples of preferred water-soluble preservatives for use in the present invention can be found in U.S. Pat. No. 5,714,137, incorporated hereinbefore by reference, as well as co-pending application PCT/US 98/12154 pages 29 to 36.

Preferred water-soluble preservatives for use in the present invention are organic sulfur compounds. Some non-limiting examples of organic sulfur compounds suitable for use in the present invention are:

(a) 3-Isothiazolone Compounds

A preferred preservative is an antimicrobial, organic preservative containing 3-isothiazolone groups. This class of compounds is disclosed in U.S. Pat. No. 4,265,899, Lewis et al., issued May 5, 1981, and incorporated herein by reference. A preferred preservative is a water-soluble mixture of 5-chloro-2-methyl-4-isothiazolin-3-one and 2-methyl-4-isothiazolin-3-one, more preferably a mixture of about 77% 5-chloro-2-methyl-4-isothiazolin-3-one and about 23% 2-methyl-4-isothiazolin-3-one, a broad spectrum preservative available as a 1.5% aqueous solution under the trade name Kathon® CG by Rohm and Haas Company.

When Kathon® is used as the preservative in the present invention it is present at a level of from about 0.0001% to about 0.01%, preferably from about 0.0002% to about 0.005%, more preferably from about 0.0003% to about 0.003%, most preferably from about 0.0004% to about 0.002%, by weight of the composition.

Other isothiazolins include 1,2-benzisothiazolin-3-one, available under the trade name Proxel® products; and 2-methyl-4,5-trimethylene-4-isothiazolin-3-one, available under the trade name Promexal®. Both Proxel and Promexal are available from Zeneca. They have stability over a wide pH range (i.e., 4–12). Neither contain active halogen and are not formaldehyde releasing preservatives. Both Proxel and Promexal are effective against typical Gram negative and positive bacteria, fungi and yeasts when used at a level from about 0.001% to about 0.5%, preferably from about 0.005% to about 0.05%, and most preferably from about 0.01% to about 0.02% by weight of the usage composition.

(b) Sodium Pyrithione

Another preferred organic sulfur preservative is sodium pyrithione, with water solubility of about 50%. When sodium pyrithione is used as the preservative in the present invention it is typically present at a level of from about 0.0001% to about 0.01%, preferably from about 0.0002% to about 0.005%, more preferably from about 0.0003% to about 0.003%, by weight of the usage composition.

Mixtures of the preferred organic sulfur compounds can also be used as the preservative in the present invention.

H. Antimicrobial Agents

Sanitization of fabrics can be achieved through the use of compositions containing, antimicrobial materials, e.g., antibacterial halogenated compounds, quaternary compounds, phenolic compounds and metallic salts, and preferably quaternary compounds. A typical disclosure of these antimicrobial can be found in International Patent Application No. PCT/US 98/12154 pages 17 to 20.

(a) Biguanides

Some of the more robust antimicrobial halogenated compounds which can function as disinfectants/sanitizers as well as finish product preservatives (vide infra), and that are useful in the compositions of the present invention include 1,1'-hexamethylene bis(5-(p-chlorophenyl)biguanide), commonly known as chlorhexidine, and its salts, e.g., with hydrochloric, acetic and gluconic acids. The digluconate salt is highly water-soluble, about 70% in water, and the diacetate salt has a solubility of about 1.8% in water.

Other useful biguanide compounds include Cosmoci® CQ®, and Vantocil® IB that include poly (hexamethylene biguanide) hydrochloride. Other useful cationic antimicrobial agents include the bis-biguanide alkanes. Usable water soluble salts of the above are chlorides, bromides, sulfates, alkyl sulfonates such as methyl sulfonate and ethyl sulfonate, phenylsulfonates such as p-methylphenyl sulfonates, nitrates, acetates, gluconates, and the like.

Examples of suitable bis biguanide compounds are chlorhexidine; 1,6-bis-(2-ethylhexylbiguanidohexane) dihydrochloride; 1,6-di-($N_1$,$N_1$'-phenyldiguanido-$N_5$,$N_5$')-hexane tetrahydrochloride; 1,6-di-($N_1$,$N_1$'-phenyl-$N_1$,$N_1$'-methyldiguanido-$N_5$,$N_5$')-hexane dihydrochloride; 1,6-di ($N_1$,$N_1$'-o-chlorophenyldiguanido-$N_5$,$N_5$')-hexane dihydrochloride; 1,6-di($N_1$,$N_1$'-2,6-dichlorophenyldiguanido-$N_5$,$N_5$')hexane dihydrochloride; 1,6-di[$N_1$,$N_1$'-.beta.-(p-methoxyphenyl) diguanido-$N_5$,$N_5$']-hexane dihydrochloride; 1,6-di($N_1$,$N_1$'-.alpha.-methyl-.beta.-phenyldiguanido-$N_5$,$N_5$')-hexane dihydrochloride; 1,6-di($N_1$,$N_1$'-p-nitrophenyldiguanido-$N_5$,$N_5$')hexane dihydrochloride;.omega.:.omega.'-di-($N_1$,$N_1$'-phenyidiguanido-$N_5$,$N_5$')-di-n-propylether dihydrochloride; omega:omega'-di($N_1$,$N_1$'-p-chlorophenyldiguanido-$N_5$,$N_5$')-di-n-propylether tetrahydrochloride; 1,6-di($N_1$,$N_1$'-2,4-dichlorophenyldiguanido-$N_5$,$N_5$')hexane tetrahydrochloride; 1,6-di($N_1$,$N_1$'-p-methylphenyldiguanido-$N_5$,$N_5$') hexane dihydrochloride; 1,6-di($N_1$,$N_1$'-2,4,5-trichlorophenyldiguanido-$N_5$,$N_5$')hexane tetrahydrochloride; 1,6-di[$N_1$,$N_1$'-.alpha.-(p-chlorophenyl) ethyldiguanido-$N_5$,$N_5$'] hexane dihydrochloride;.omega.:.omega.'di($N_1$,$N_1$'-p-chlorophenyldiguanido-$N_5$,$N_5$')m-xylene dihydrochloride; 1,12-di($N_1$,$N_1$'-p-chlorophenyldiguanido-$N_5$,$N_5$') dodecane dihydrochloride; 1,10-di($N_1$,$N_1$'-phenyldiguanido-$N_5$,$N_5$')-decane tetrahydrochloride; 1,12-di($N_1$,$N_1$'-phenyldiguanido-$N_5$,$N_5$') dodecane tetrahydrochloride; 1,6-di($N_1$,$N_1$'-o-chlorophenyldiguanido-$N_5$,$N_5$') hexane dihydrochloride; 1,6-di($N_1$,$N_1$'-p-chlorophenyldiguanido-$N_5$,$N_5$')-hexane tetrahydrochloride; ethylene bis (1-tolyl biguanide); ethylene bis (p-tolyl biguanide); ethylene bis(3,5-dimethylphenyl biguanide); ethylene bis(p-tert-amylphenyl biguanide); ethylene bis(nonylphenyl biguanide); ethylene bis (phenyl biguanide); ethylene bis (N-butylphenyl biguanide); ethylene bis (2,5-diethoxyphenyl biguanide); ethylene bis(2,4-dimethylphenyl biguanide); ethylene bis(o-diphenylbiguanide); ethylene bis(mixed amyl naphthyl biguanide); N-butyl ethylene bis(phenylbiguanide); trimethylene bis(o-tolyl biguanide); N-butyl trimethylene bis (phenyl biguanide); and the corresponding pharmaceutically acceptable salts of all of the above such as the acetates; gluconates; hydrochlorides; hydrobromides; citrates; bisulfites; fluorides; polymaleates; N-coconutalkylsarcosinates; phosphites; hypophosphites; perfluorooctanoates; silicates; sorbates; salicylates; maleates; tartrates; fumarates; ethylenediaminetetraacetates; iminodiacetates; cinnamates; thiocyanates; arginates; pyromellitates; tetracarboxybutyrates; benzoates; glutarates; monofluorophosphates; and perfluoropropionates, and mixtures thereof. Preferred antimicrobials from this group are 1,6-di-($N_1$,$N_1$'-phenyldiguanido-$N_5$,$N_5$')-hexane tetrahydrochloride; 1,6-di($N_1$,$N_1$'-o-chlorophenyldiguanido-$N_5$,$N_5$')-hexane dihydrochloride; 1,6-di($N_1$,$N_1$'-2,6-dichlorophenyldiguanido-$N_5$,$N_5$')hexane dihydrochloride; 1,6-di($N_1$,$N_1$'-2,4-dichlorophenyldiguanido-$N_5$,$N_5$')hexane tetrahydrochloride; 1,6-di[$N_1$,$N_1$'-.alpha.-(p-chlorophenyl) ethyldiguanido-$N_5$,$N_5$'] hexane dihydrochloride;.omega.:.omega.'di($N_1$,$N_1$'-p-chlorophenyldiguanido-$N_5$,$N_5$')m-xylene dihydrochloride; 1,12-di($N_1$,$N_1$'-p-chlorophenyldiguanido-$N_5$,$N_5$') dodecane dihydrochloride; 1,6-di($N_1$,$N_1$'-o-chlorophenyldiguanido-$N_5$,$N_5$') hexane dihydrochloride; 1,6-di($N_1$,$N_1$'-p-chlorophenyldiguanido-$N_5$,$N_5$')-hexane tetrahydrochloride; and mixtures thereof; more preferably, 1,6-di($N_1$,$N_1$'-o-chlorophenyldiguanido-$N_5$,$N_5$')-hexane dihydrochloride; 1,6-di($N_1$,$N_1$'-2,6-dichlorophenyldiguanido-$N_5$,$N_5$')hexane dihydrochloride; 1,6-di($N_1$,$N_1$'-2,4-dichlorophenyldiguanido-$N_5$,$N_5$')hexane tetrahydrochloride; 1,6-di[$N_1$,$N_1$'-.alpha.-(p-chlorophenyl) ethyldiguanido-$N_5$,$N_5$] hexane dihydrochloride;.omega.:.omega.'di($N_1$,$N_1$'-p-chlorophenyldiguanido-$N_5$,$N_5$')m-xylene dihydrochloride; 1,12-di($N_1$,$N_1$'-p-chlorophenyldiguanido-$N_5$,$N_5$') dodecane dihydrochloride; 1,6-di($N_1$,$N_1$'-o-chlorophenyldiguanido-$N_5$,$N_5$') hexane dihydrochloride; 1,6-di($N_1$,$N_1$'-p-chlorophenyldiguanido-$N_5$,$N_5$')-hexane tetrahydrochloride; and mixtures thereof. As stated hereinbefore, the bis biguanide of choice is chlorhexidine its salts, e.g., digluconate, dihydrochloride, diacetate, and mixtures thereof.

(b) Quaternary Compounds

A wide range of quaternary compounds can also be used as antimicrobial actives for the compositions of the present invention. Non-limiting examples of useful quaternary compounds include: (1) benzalkonium chlorides and/or substituted benzalkonium chlorides such as commercially available Barquat® (available from Lonza), Maquat® (available from Mason), Variquat® (available from Goldschmidt), and Hyamine® (available from Lonza); (2) di($C_6$–$C_{14}$)alkyl di short chain ($C_{14}$ alkyl and/or hydroxyalkyl) quaternary such as Bardac® products of Lonza, (3) N-(3-chloroallyl) hexaminium chlorides such as Dowicide® and Dowicil® available from Dow; (4) benzethonium chloride such as Hyamine® 1622 from Rohm & Haas; (5) methylbenzethonium chloride represented by Hyamine® 10X supplied by Rohm & Haas, (6) cetylpyridinium chloride such as Cepacol chloride available from of Merrell Labs. Examples of the preferred dialkyl quaternary compounds are di($C_8$–$C_{12}$) dialkyl dimethyl ammonium chloride, such as didecyldimethylammonium chloride (Bardac 22), and dioctyldimethylammonium chloride (Bardac 2050).

Surfactants, when added to the antimicrobials tend to provide improved antimicrobial action. This is especially true for the siloxane surfactants, and especially when the siloxane surfactants are combined with the chlorhexidine antimicrobial actives.

Examples of bactericides used in the compositions and articles of this invention include glutaraldehyde, formaldehyde, 2-bromo-2-nitro-propane-1,3-diol sold by Inolex Chemicals, located in Philadelphia, Pa., under the trade name Bronopol®, and a mixture of 5-chloro-2-methyl-4-isothiazoline-3-one and 2-methyl-4-isothiazoline-3-one sold by Rohm and Haas Company under the trade name Kathon CG/ICP®.

(c) Metallic Salts

Many metallic salts are known for their antimicrobial effects. These metallic salts may be selected from the group consisting of copper salts, zinc salts, and mixtures thereof.

Copper salts have some antimicrobial benefits. Specifically, cupric abietate acts as a fungicide, copper acetate acts as a mildew inhibitor, cupric chloride acts as a fungicide, copper lactate acts as a fungicide, and copper sulfate acts as a germicide. Copper salts also possess some malodor control abilities. For instance, U.S. Pat. No. 3,172,817, Leupold, et al., describes deodorizing compositions for treating disposable articles, comprising at least slightly water-soluble salts of acylacetone, including copper salts and zinc salts.

I. Other Optionals

The present invention composition may also include optional components conventionally used in textile treatment compositions, for example: brighteners, photoactivated bleaching agents such as the sulfonated zinc and/or aluminum phthalocyanines, perfumes, chlorine scavengers, colorants; surfactants; anti-shrinkage agents; fabric crisping agents; spotting agents; germicides; fungicides; antioxidants such as butylated hydroxy toluene, anti-corrosion agents, and mixtures thereof.

V. Form of the Composition

The composition of the invention may take a variety of physical forms including liquid, liquid-gel, paste-like, foam in either aqueous or non-aqueous form, powder, granular and tablet forms. For better dispersability, a preferred form of the composition is a liquid form.

When in a liquid form, the composition may also be dispensed by a dispensing means such as a spray dispenser, or aerosol dispenser. In a highly preferred embodiment, the rinse-added fabric treatment composition is contained in a bottle with a pour spout.

VI. Methods of Use

Rinse Process

This can be done in a so-called rinse process, where a composition as defined herein, is first diluted in water to form an aqueous rinse bath solution. Subsequently, the laundered fabrics which have been washed with a detergent liquor are placed in the rinse bath solution with the diluted composition. Of course, the composition may also be incorporated into the aqueous bath once the fabrics have been immersed therein. Typically, the fabrics will contain detergent residue, and more specifically, surfactant residue on/attached to the fabric, in the detergent liquor which is still associated with the fabrics, etc.

Following that step, the fabrics are rinsed according to the conventional process of agitation whereby the suds collapse, and optionally further rinsing with water. The fabric can then be optionally wrung out for drying. Accordingly, there is provided a method for rinsing fabrics, which comprises the steps of contacting fabrics, previously contacted with a detergent liquor, with a composition of the invention.

This rinse process may be performed manually in basin or bucket, in a non-automated washing machine, or in an automated washing machine. When hand washing/rinsing is performed, the laundered fabrics are removed from the detergent liquor, and wrung out to remove excess detergent solution. Meanwhile, the detergent liquor is removed from the drum and replaced by fresh water. The composition of the invention is then added to the water and the fabrics are then rinsed according to the conventional rinsing habit.

Pre-Treatment and/or Soaking Process

Still in a further aspect of the invention, it has been found that the compositions of the invention are also suitable for use in a pre-treatment process and/or soaking processes. In particular, the use of the composition has been found to be very effective on collars and socks which conventionally are the items and/or locations which are the most difficult to clean.

This treatment can be done either in a so-called "pretreatment mode", where a composition, as defined herein, is applied neat onto said fabrics before the fabrics are rinsed, or washed then rinsed, or in a "soaking mode" where a composition, as defined herein, is first diluted in an aqueous bath and the fabrics are immersed and soaked in the bath, before they are rinsed. It is also essential in both cases, that the fabrics be rinsed after they have been contacted with said composition, before the fabrics have dried.

Method for Reducing Surfactant Residue Via a Chaperone Mechanism

The present invention also relates to a method for reducing surfactant residue on a fabric via a chaperone mechanism, whereby a fabric containing surfactant residue is contacted by a rinse-added fabric treatment composition containing a RRA. The RRA has a hydrophilic portion and a surfactant-attracting portion selected from the group consisting of a hydrophobic moiety, an alkoxy moiety, a charged moiety, and a mixture thereof. Preferably the charged moiety has a charge which is opposite that of the surfactant residue to be removed from the fabric. Once a rinse bath solution is formed by adding the rinse-added fabric treatment composition to water, the fabric is contacted with the rinse bath solution. Without intending to be limited by theory, it is believed that the RRA then is attracted to the surfactant residue, via ion-paring, hydrophobic/hydrophilic interactions, etc., such that the surfactant residue and the RRA form a non-covalent bond. The hydrophilic portion of the RRA then assists in pulling the surfactant residue (which is still non-covalently bonded to the RRA) into the rinse bath solution, and away from/off of the fabric, so as to reduce the level of surfactant residue in/on the fabric.

The compositions according to the present invention may be used in neat or diluted form. However the compositions herein are typically used in diluted form in a laundry operation. By "in diluted form", it is meant herein that the compositions for the treating of fabrics according to the present invention may be diluted by the user, preferably with water. Such dilution may occur for instance in hand washing applications as well as by other means such as in a washing machine. Said compositions can be diluted 1 to about 10,000, preferably 1 to about 5,000, and more preferably from 1 to about 300 to 1 to about 600 times. Typical rinse dilutions are of about 500 to 550 times (approx. 20 ml in 10 L) for use in hand rinsing, and of about 375–425 times for use in a automated and non-automated washing machine (90 ml in 35 liters). These amounts will vary where the composition is to be used in combination with a fabric softener composition. Where the use of a fabric softener composition is desired, it is preferred that the laundered fabrics be rinsed in a composition of the present invention early in the rinse cycle or during a first rinse cycle, and that the fabric softening composition be added late in the rinse cycle or during the last rinse cycle where multiple rinse cycles are used.

More specifically, the process of soaking the fabrics according to the present invention comprises the steps of first contacting said fabrics with a composition according to the present invention, in its diluted form, then allowing said fabrics to remain in contact with said composition, for a period of time sufficient to treat said fabrics, typically 1 minute to 24 hours, preferably 1 to 60 minutes, more preferably 1 to 5 minutes, then complete the rinsing of said fabrics as done usually (agitation, optional rinse, and wringing). If said fabrics are to be washed, i.e., with a conventional detergent composition preferably comprising at least one surface active agent, said washing may be subsequently followed by a rinse step comprising a composition of the invention.

In another embodiment of the present invention the process of pre-treating fabrics comprises the step of contacting fabrics with a composition according to the present invention, in its neat form and allowing said fabrics to remain in contact with said composition for a period of time sufficient to clean said fabrics, typically 5 seconds to 30 minutes, preferably 1 minute to 10 minutes and then rinsing said fabrics with water. If said fabrics are to be washed, i.e., with a conventional detergent composition comprising at least one surface active agent, said washing may be conducted before or after that said fabrics have been pre-treated. Advantageously, the present invention provides compositions that may be applied neat onto a fabric; the present compositions being safe to colors and fabrics per se.

Alternatively instead of following the neat method as described herein above (pretreater application) by a rinsing step with water and/or a conventional washing step with a liquid or powder conventional detergent, the pre-treatment operation may also be followed by the diluted washing process as described herein before either in bucket (hand operation) or in a washing machine.

For the purposes of the present invention the term "contacting" is defined as "intimate contact of a fabric with an aqueous solution of the hereinabove described composition which comprises a suds suppressing system." Contacting typically occurs by soaking, washing, rinsing, spraying the composition onto fabric, but can also include contact of a substrate inter alia a material onto which the composition has been absorbed, with the fabric. Hand treatment is a preferred process. Temperatures for treatment can take place at a variety of temperatures, however, treatment typically occurs at a temperature less than about 30° C., preferably from about 5° C. to about 25° C.

The invention is illustrated in the following non limiting examples, in which all percentages are on a weight basis unless otherwise stated.

EXAMPLE 1

In Example 1, the abbreviated component identifications have the following meanings:

| | |
|---|---|
| Suds Sup: | DC2-3000 commercially available from Dow Corning |
| Sil DM: | Dimethicone derived: Silwet L-7000 from OSi specialties |
| Gum A: | HydroxyMethylPropylCellulose commercially available from Fluka |
| Gum B: | Xanthan Gum commercially available from Rhodia |
| Antimicrobial: | Glutaraldehyde from Aldrich |
| Acidifying A: | Citric Acid |
| Acidifying B: | Maleic Acid |
| Acidifying C: | Succinic Acid |
| Buffer: | Di-sodium hydrogen phosphate |
| Chelant: | Diethylenetriaminepentamethylphosphonic acid |
| Ca Inhibitor: | Hydroxyethyldiphosphonic acid |

The following rinse added fabric treatment compositions are in accordance with the present invention.

| | A | B | C | D | E | F | G |
|---|---|---|---|---|---|---|---|
| Acidifying A | 1 | 3 | 6 | 1 | 4 | nil | nil |
| Acidifying B | nil | nil | nil | 2 | 2 | 1 | 3 |
| Acidifying C | nil | nil | nil | nil | nil | nil | nil |
| Buffer | * | * | * | * | * | * | * |
| Chelant | 0.6 | nil | 0.6 | 0.6 | nil | 0.6 | 0.6 |
| Ca inhibitor | nil | 0.6 | 0.6 | nil | 0.6 | 0.6 | nil |
| b-Cyclodextrin | 0.5 | nil | 0.5 | 0.5 | nil | 0.5 | 0.5 |
| Dimethicone | nil | 0.5 | nil | nil | 0.5 | nil | nil |
| Suds Sup | nil | nil | 1.0 | nil | nil | 1.0 | nil |
| Gum A | 2 | nil | nil | 2 | nil | nil | 2 |
| Gum B | nil | 0.2 | nil | nil | 0.2 | nil | nil |
| Antimicrobial | 0.002 | 0.002 | 0.002 | 0.002 | 0.002 | 0.002 | 0.002 |
| Perfume | nil | 0.4 | 0.4 | nil | 0.4 | 0.4 | nil |
| Minors/water | bal | bal | bal | bal | bal | bal | bal |

| | H | I | J | K | L | M |
|---|---|---|---|---|---|---|
| Acidifying A | nil | 1 | 4 | nil | nil | nil |
| Acidifying B | 6 | nil | nil | nil | nil | nil |
| Acidifying C | nil | 2 | 2 | 1 | 3 | 6 |
| Buffer | * | * | * | * | * | * |
| Chelant | nil | nil | 0.6 | nil | 0.6 | 0.6 |
| Ca inhibitor | 0.6 | 0.6 | 0.6 | 0.6 | 0.6 | nil |
| b-Cyclodextrin | nil | nil | 0.5 | nil | 0.5 | 0.5 |
| Dimethicone | 0.5 | 0.5 | nil | 0.5 | nil | nil |
| Suds Sup | nil | nil | 1.0 | nil | 1.0 | nil |
| Gum A | nil | nil | nil | nil | nil | 2 |
| Gum B | 0.2 | 0.2 | nil | 0.2 | nil | nil |
| Antimicrobial | 0.002 | 0.002 | 0.002 | 0.002 | 0.002 | 0.002 |
| Perfume | 0.4 | 0.4 | 0.4 | 0.4 | 0.4 | nil |
| Minors/water | bal | bal | bal | bal | bal | bal |

* Amount to deliver a final solution having a pH between about 4 and about 7.

EXAMPLE 2

In Example 2, the following abbreviated component identifications have the following meanings:

Suds Sup: SE39 silicone gum commercially available from Wacker-Chemie, Silicone 3565 commercially available from Dow Corning, Silicone 2–3000 available from Dow Corning, 2-Butyloctanol commercially available as ISOFOL12 from Condea, or a combination thereof.

Gum: Carbomethoxycellulose commercially available from Fluka, Xanthan Gum commercially available from Aldrich Chemicals, succinoglycan polysaccharide gum commercially available from Rhodia, or a combination thereof.

Antibacterial: Triclosan commercially available from Aldrich Chemicals.

Acidifying: Citric Acid, Maleic Acid, or a combination thereof.

RRA: RRA as defined herein above, e.g. of Formulas 1–4, or a combination thereof.

Buffering: Sodium hydrogenophosphate, sodium tripolyphosphate, or a combination thereof.

Chelant: Diethyleneamine pentamethylphosphonic acid.

Ca Inhibitor ("sequestrant"): Hydroxyethyldiphosphonic acid.

Polymer: Polyethylene imine ethoxylated with 7 moles of ethylene oxide (MW 1800, at 50% active); Polyethylene imine ethoxylated with 20 moles of ethylene oxide (MW 600, at 50% active), or a combination thereof.

Photobleach: Zinc phthalocyanine.

Minors: optical brightener, water, dye, etc.

The following fabric hand treatment compositions are formed in accordance with the present invention.

| | A | B | C | D | E | F | G | H |
|---|---|---|---|---|---|---|---|---|
| Suds Sup | 40 | 0.1 | 80 | 0.8 | 90 | 5 | 1 | 0.1 |
| Gum | — | — | — | — | — | — | 5 | 5 |
| RRA | 2 | 2 | 2 | 1 | 3 | 0.5 | 2.5 | 2 |
| Perfume | 0.8 | 0.5 | 1 | 0.5 | 1 | 0.5 | 0.5 | 0.5 |
| Minors/water | to balance to 100% | | | | | | | |

| | I | J | K | L | M | N | O | P |
|---|---|---|---|---|---|---|---|---|
| Suds Sup | 5 | 0.5 | 1.5 | 1.5 | 0.5 | 0.1 | 1.5 | 1.5 |
| Gum | 0.1 | 0.5 | 5 | 0.5 | 0.5 | 0.1 | 5– | 0.5 |
| RRA | 1.5 | 1.5 | 2 | 2 | 1 | 2 | 4 | 3 |
| Acidifying | — | — | — | — | 5 | 1 | 5 | 5 |
| Perfume | 0.5 | 0.5 | 0.5 | 0.5 | 0.5 | 0.5 | 0.5 | 0.5 |
| Minors/water | to balance to 100% | | | | | | | |

| | Q | R | S | T | U | V | W | X |
|---|---|---|---|---|---|---|---|---|
| Suds Sup | 0.5 | 0.1 | 1.5 | 1.5 | 1 | 0.5 | 5 | 1.5 |
| Gum | 0.5 | 0.1 | 5 | 0.5 | 1 | 0.5 | 0.5 | 5 |
| Acidifying | 5 | 1 | 5 | 5 | 20 | 5 | 5 | 5 |
| Buffering | 2.5 | 0.5 | 2.5 | 2.5 | 10 | 2 | 2 | 2 |
| RRA | 2 | 2 | 1.5 | 1.5 | 10 | 5 | 5 | 3 |
| Perfume | 0.5 | 0.5 | 0.5 | 0.5 | 0.5 | 0.5 | 0.5 | 0.5 |
| Minors/water | to balance to 100% | | | | | | | |

| | Y | Z | AA | BA | CA | DA | EA | FA |
|---|---|---|---|---|---|---|---|---|
| Suds Sup | 0.5 | 0.1 | 1.5 | 1.5 | 0.5 | 0.1 | 1.5 | 1.5 |
| Gum | 0.5 | 0.1 | 5 | 0.5 | 0.5 | 0.1 | 5 | 0.5 |
| RRA | 2 | 2.5 | 2.5 | 2 | 1 | 1.5 | 4 | 1.5 |
| Acidifying | 5 | 1 | 5 | 5 | 5 | 1 | 5 | 5 |
| Buffering | 2.5 | 0.5 | 2.5 | 2.5 | 2.5 | 0.5 | 2.5 | 2.5 |
| Perfume | 0.5 | 0.5 | 0.5 | 0.5 | 0.5 | 0.5 | 0.5 | 0.5 |
| Minors/water | to balance to 100% | | | | | | | |

| | GA | HA | IA | KA | LA | MA | NA | OA |
|---|---|---|---|---|---|---|---|---|
| Suds Sup | 0.6 | 0.1 | 1.5 | 1.5 | 0.5 | 0.1 | 1.5 | 1.5 |
| Gum | 0.2 | 0.1 | 5 | 0.5 | 0.5 | 0.1 | 5 | 0.5 |
| Antibacterial | — | — | — | — | 1 | 1 | 1 | 1 |
| Acidifying | 7.5 | 1 | 5 | 5 | 5 | 1 | 5 | 5 |
| Buffering | — | 0.5 | 2.5 | 2.5 | 2.5 | 0.5 | 2.5 | 2.5 |
| Chelant | 1 | 1 | 1 | 1 | 1 | 1 | 1 | 1 |
| Ca Inhibitor | 1 | 1 | 1 | 1 | 1 | 1 | 1 | 1 |
| RRA | 2 | 1.8 | 2.5 | 2.5 | 3 | 1 | 1 | 2 |
| Polymer | — | — | 1 | — | 1 | — | 1 | — |
| Photobleach | — | — | — | 0.001 | 0.001 | — | — | 0.001 |
| Perfume | 0.5 | 0.5 | 0.5 | 0.5 | 0.5 | 0.5 | 0.5 | 0.5 |
| Minors/water | to balance to 100% | | | | | | | |

EXAMPLE 3

A rinse-added fabric treatment composition is provided containing 2% RRA according to Formula 1, wherein $R_1$=$C_{12-15}$ hydrocarbyl (derived from coconut oil), $R_2$=methyl, $R_3$=ethyl, and Q=H. Both a and b indicate average degrees of ethoxylation and are each 7.5, and $X^-$ is chloride ion. This RRA is available as ETHOQUAD-C25, from Akzo-Nobel. The rinse-added fabric treatment composition also contains 0.6% SE39 silicone gum suds suppresser from Wacker-Chemie, 1.8% metal ion control agents, 7.5% citric acid, and the balance water and minor ingredients.

The fabric rinse-added fabric treatment composition is provided in a bottle containing an instruction set printed on the side of the bottle. The written instruction set recommends to add 20 mL of the rinse-added fabric treatment composition for every 10 L of water used to make a rinse bath solution. The fabrics are then to be wrung out of excess laundry liquor and immersed in the rinse bath solution and agitated for from about 5 to about 10 minutes. These steps are to be repeated, if needed, to achieve the desired level of rinsing. The instruction set also recommends that after rinsing, the fabrics may be wrung out and/or dried as desired. The written instruction set also includes an internet web address where interested consumers may find additional recommendations for using the rinse-added fabric treatment composition.

When 20 mL of the rinse-added fabric treatment composition is added to 10 L of water, the resulting rinse bath solution has an initial pH of about 5. The rinse-added fabric treatment composition provides a rinsing capacity of 3, as compared to a similarly-processed shirt in which the rinse bath solution is only water. Furthermore, this result corresponds to the results of the rinse water reduction test. When this composition is tested according to the rinse-water reduction test, it is found that one 10 L rinsing basin is sufficient to rinse the first set of shirts, whereas three 10 L rinsing basins full of water are required to sufficiently rinse the second set of shirts. Accordingly, this composition has a rinse water reduction of 67%.

VII. Methods for Improving Whiteness, Softness, Cleaning and Stain Removal During Laundering It has been found that the use of the compositions of the present invention in the rinse bath solution facilitates the removal of laundry residue and prevents the re-deposition of such residue on the from the laundered fabrics. The absence of such residues provides a number of benefits to the fabrics including but not limited to improved whiteness, an improved feel or softness, and improved stain removal and cleaning. These benefits are achieved by using the compositions of the present invention in the manner described in the preceding section concerning methods of use. Furthermore, these improvements in whiteness, softness and cleaning are obtained without the addition of bleaching agents, conventional softener compounds or detergents in the rinse bath solution. These improvements are achieved not by depositing additional agents or surfactants on the fabrics but by removing such materials and thereby restoring the fabric to its natural state.

The performance of the compositions of the present invention, in terms of fabric care benefits such as maintaining and restoring whiteness, providing softness and removing stains, has been compared with the performance of conventional materials.

Specifically, rinsing laundered fabrics with the compositions of the present invention has been compared with rinsing such fabrics with water, both in the presence and absence of fabric softeners or fabric conditioners. In this test, items such as white towels, socks and t-shirts were washed 10 times in hard water with soil. These clothing items were then washed in an automated washing machine in conventional detergent. For one half of the items, 70 mis of a composition according to Example 1 was added to the rinse bath (approximately 15–17 liters of water) while the other half of the items were rinsed in water only. These items were dried and inspected for their whiteness and softness.

For purposes of testing the cleaning characteristics of the composition, soiled consumer garments were washed one time in an automatic washing machine in conventional detergent and soil. One half of the garments were rinsed with about 70 mls of a composition according to Example 1 being added to the rinse bath, and the other half being rinsed in water only.

An expert panel was used to inspect the clothing items and to select which item exhibited the fabric care benefit to the greater degree. The panelists were not asked to grade the items individually but merely to make this comparison. The results are tabulated below.

TABLE 1

Use of Treatment Composition In The Rinse Without Fabric Softener

| Benefit | Detergent + Water rinse | Detergent + Rinse with Water + Composition |
|---|---|---|
| Whiteness | 8% | 92% |
| Cleaning | 10% | 90% |
| Softness | 16% | 84% |

TABLE 2

Use of Treatment Composition In The Rinse with Fabric Softener

| Benefit | Detergent + Rinse with Water/Fabric Softener | Detergent + Rinse with Water + Composition/Fabric Softener |
|---|---|---|
| Whiteness | 4% | 96% |
| Cleaning | 6% | 94% |

Likewise, the use of the compositions as a pre-wash followed by conventional laundering was compared with laundering without a pre-wash. The method of preparing the clothing items for testing the whiteness of the laundered/rinsed fabrics was identical to that described above.

TABLE 3

Use of Treatment Composition During Pre-Wash

| Benefit | No Pre-Wash | Pre-wash with Composition |
|---|---|---|
| Whiteness | 12% | 88% |

In addition, the performance of the compositions of the present invention at removing specific types of stains was tested using the compositions of the present invention as a pre-soak composition to facilitate stain removal during laundering. For pre-soaking, the clothing items were soiled with the staining material. One half of the stained fabrics were allowed to soak in water for 1 hour without agitation in a solution of a conventional pre-soaking composition. The other half were soaked for 1 hour in a diluted solution of the present composition that was prepared from 100 mls of a composition in 5 liters of water according to Example 1. All clothes were then washed, dried and inspected. The results are tabulated below in Table 4.

The compositions of the present invention were also tested for their use as a pre-treatment by comparing clothes washed using conventional detergent as a pre-treatment solution with clothes washed using the present compositions as a pre-treatment. In the testing procedure one half of the clothing stains were contacted with conventional liquid detergent. The other half were put in contact with a neat solution of a composition of the present invention according to Example 1. All of the stained clothing was then washed in conventional detergent in an automated washing machine before drying and inspection. The pre-soaked/pre-treated items were inspected by the expert panel to determine which solutions exhibited the greater stain removal benefit on each type of stain. As indicated in the Table 5 below, the compositions of the present invention were found to exhibit a strong ability to remove stains, particularly on bleachable stains resulting from tea, wine and clay.

TABLE 4

Use of Treatment Composition As Pre-Soaker

| Stain Type | Detergent Pre-Soak | Composition |
|---|---|---|
| Make Up | 17% | 83% |
| Tea | 0% | 100% |
| Wine | 0% | 100% |
| Payless Blue | 0% | 100% |
| ETC clay | 0% | 100% |

TABLE 5

Use of Treatment Composition As Pre-Treatment

| Stain Type | Detergent Pre-Treatment | Composition |
|---|---|---|
| BarBQue Sauce | 0% | 100% |
| Margarine | 0% | 100% |
| Wine | 0% | 100% |
| ETC clay | 0% | 100% |

VIII. Kit and Instruction Set for a Rinse-Added Fabric Treatment Composition

It has now been recognized that with such a novel and new rinse-added fabric treatment composition, the typical consumer will not immediately know how to appropriately use the composition so as to achieve optimal results. Accordingly, the rinse-added fabric treatment composition will typically be sold as a kit for increasing the rinsing capacity of water, which includes a novel instruction set to explain to the consumer the recommended methods for using the composition, such as described herein. Any instruction set which includes a recommendation to use any of the methods of use described above are thus specifically included herein.

More typically, the instruction set will typically comprise a recommendation for a consumer to 1) add the rinse-added fabric treatment composition to water, which may already contain a fabric, so as to form a rinse bath solution, 2) add the fabric, if not already present, to the rinse bath solution, 3) agitate the fabric in the rinse bath solution to remove the detergent and/or surfactant residue, and 4) remove the fabric from the rinse bath solution. Optionally, the instruction set may further include a recommendation to wring dry and/or spin dry the fabric prior to adding it to the water/rinse bath solution, and/or after removing it from the rinse bath solution. In a highly preferred embodiment, the instruction set includes a recommendation for a consumer to add the rinse-added fabric treatment composition to water to form a rinse bath solution, to add a fabric to the rinse bath solution, agitate and/or manipulate the fabric in the rinse bath solution, and to remove the fabric from the rinse bath solution.

Such an instruction set may be provided by any embodiment which is easily perceivable and understandable by the consumer. Audio, visual, and/or tactile embodiments are therefore preferred, such as graphics, drawings, words, Braille, verbal instructions recorded on a microchip or other recording device, etc.

In an embodiment of the kit herein, the instruction set may merely indicate to a consumer where detailed recommendations and/or consumer specific recommendations may be found. For example, the instruction set may include and/or solely consist of contact information, a telephone number, an internet web address, an internet download site, etc. which a consumer may contact so as to receive detailed instructions and/or consumer specific instructions on methods of use. Such information is preferably a personalized recommendation which tailors a method of use according to variables such as the consumer's local and/or personal water conditions, climate conditions, laundry conditions, etc. Such variables may be determined according to a database which employs statistical methods to correlate the consumer's location with likely local conditions, and/or may be provided directly or indirectly by the consumer themselves. Furthermore, the detailed recommendations and/or consumer specific recommendations may include variables such as agitation/manipulation timing, rinse-added fabric treatment composition concentration, optimization according to the detergent composition and/or concentration used by the consumer, etc. Such recommendations may be provided either directly or indirectly, preferably directly, to the consumer.

What is claimed is:

1. A rinse-added fabric treatment composition for increasing the rinsing capacity of an aqueous rinse bath solution, the composition comprising a rinse aid comprising a pH control agent, a suds suppression system and a residue reduction agent comprising one or more alkoxylated repeating groups, characterized in that when the composition is diluted in a rinse bath solution, said rinse bath solution has a rinsing capacity greater than 1, where water has a rinsing capacity of 1.

2. The fabric treatment composition of claim 1, wherein the rinse bath solution has a rinse capacity greater than about 2.

3. The fabric treatment composition of claim 1, wherein the rinse bath solution has a rinse capacity greater than about 2.5.

4. The fabric treatment composition of claim 1, wherein the pH control agent contains an effective amount of an acid to reduce the pH of the rinse bath solution to less than about 6.5.

5. The fabric treatment composition of claim 1, wherein the pH control agent contains an effective amount of an acid to reduce the pH of the rinse bath solution to less than about 5.75.

6. The fabric treatment composition of claim 1, wherein the pH control agent contains an effective amount of an acid to reduce the pH of the rinse bath solution to less than about 5.

7. The fabric treatment composition of claim 1, wherein the suds suppression system contains an anti-foaming agent, the suds suppression system comprising from about 0.01% to about 99% by weight of the fabric treatment composition.

8. The fabric treatment composition of claim 7, wherein the anti-foaming agent is selected from the group consisting of silicone compounds, polyethylene glycol derivatives, fatty acids and their salts, high molecular weight hydrocarbons, copolymers of ethylene oxide and propylene oxide, secondary alcohols, mono-alkyl quaternary ammonium compounds, and mixtures thereof.

9. A rinse-added fabric treatment composition for reducing surfactant residue on a fabric which forms a rinse bath solution when added to water, comprising:

A. a residue reduction agent selected from the group consisting of a cationic residue reduction agent, a zwitterionic residue reduction agent, and a combination thereof wherein said residue reduction agent comprises one or more alkoxylated repeating groups;

B. a suds suppression system; and a pH control agent which provides the rinse bath solution with a pH of less than 7.0.

10. The rinse-added fabric treatment composition of claim 9, wherein when the composition is added to water to form a rinse bath solution, and wherein when the fabric is contacted with the rinse bath solution, the rinse bath solution has a rinsing capacity of at least about 2.

11. The composition of claim 9, pH control agent provides the rinse bath solution with a pH of less than about 6.5.

12. The composition of claim 9, wherein the residue reduction agent has the formula:

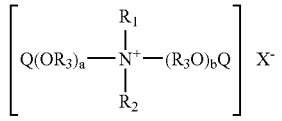

wherein $R_1$ is a $C_{12-15}$ alkyl group, wherein $R_2$ is methyl, wherein each $R_3$ is ethyl;
wherein each Q is H, wherein a is about 7.5, wherein b is about 7.5, and wherein $X^-$ is chloride.

13. The composition of claim 9, wherein the composition comprises, by weight, from about 0.05% to about 10% residue reduction agent.

14. The fabric treatment composition of claim 9, wherein the suds suppression system comprises an anti-foaming agent selected from the group consisting of silicone compounds, polyethylene glycol derivatives, fatty acids and their salts, high molecular weight hydrocarbons, copolymers of ethylene oxide and propylene oxide, secondary alcohols, mono-alkyl quaternary ammonium compounds, and mixtures thereof.

15. A method for increasing the rinsing capacity of water, comprising the step of adding an effective amount of a fabric treatment composition according to claim 5 to water to form a rinse bath solution.

16. A kit for improving the rinsing capacity of water comprising:

A. a rinse-added fabric treatment composition of claim 9; and

B. an instruction set.

17. A kit according to claim 16, wherein the instruction set comprises a recommendation to:

A. add the rinse-added fabric treatment composition to water to form a rinse bath solution;

B. add a fabric to the rinse bath solution;

C. agitate and/or manipulate the fabric in the rinse bath solution; and

D. remove the fabric from the rinse bath solution.

18. A rinse bath solution comprising:

A. water; and

B. an effective amount of the fabric treatment composition of claim 9.

* * * * *